US011185759B2

(12) United States Patent
Walker

(10) Patent No.: US 11,185,759 B2
(45) Date of Patent: Nov. 30, 2021

(54) RFID SYSTEM FOR FACILITATING SELECTIONS AT A TABLE GAME APPARATUS

(71) Applicant: Walker Digital Table Systems, LLC, Las Vegas, NV (US)

(72) Inventor: Jay S. Walker, Ridgefield, CT (US)

(73) Assignee: Walker Digital Table Systems, LLC, Las Vegas, NV (US)

( * ) Notice: Subject to any disclaimer, the term of this patent is extended or adjusted under 35 U.S.C. 154(b) by 0 days.

(21) Appl. No.: 16/673,928

(22) Filed: Nov. 4, 2019

(65) Prior Publication Data

US 2020/0061449 A1 Feb. 27, 2020

Related U.S. Application Data

(63) Continuation of application No. 15/916,117, filed on Mar. 8, 2018, now Pat. No. 10,486,054, which is a (Continued)

(51) Int. Cl.
*A63F 1/06* (2006.01)
*G07F 1/06* (2006.01)

(Continued)

(52) U.S. Cl.
CPC ..... *A63F 1/06* (2013.01); *A63F 1/00* (2013.01); *A63F 1/065* (2013.01); *A63F 1/067* (2013.01);

(Continued)

(58) Field of Classification Search
CPC ..... A63F 1/06; G07F 17/322
See application file for complete search history.

(56) References Cited

U.S. PATENT DOCUMENTS 3,556,531 A 1/1971 Elder
3,770,269 A 11/1973 Elder (Continued)

FOREIGN PATENT DOCUMENTS

JP 2005342175 12/2005
WO WO9910849 8/1998

OTHER PUBLICATIONS

Office Action for U.S. Appl. No. 12/092,548 dated May 10, 2012; 7 pps.

(Continued)

*Primary Examiner* — Seng H Lim
(74) *Attorney, Agent, or Firm* — RowanTree Law Group, PLLC; Magdalena M. Fincham

(57) ABSTRACT

In accordance with some embodiments, a system for facilitating a card game is equipped with RFID antennas or interrogators operable to detect initial wagers placed by players on a table surface of the system. The system is further equipped with an electronic shoe which deals cards for the game and a processor with is operable to receive data both from the RFID antennas and the electronic shoe. Upon receiving data from an RFID antenna that a player has placed an initial wager based on initial odds and receiving data identifying some (but not all) cards dealt for a hand, the processor is operable to calculate adjusted odds for a re-characterization wager that would replace the initial wager, and output on a display of the system an offer for the re-characterization wager that corresponds to adjusted odds.

11 Claims, 17 Drawing Sheets

Related U.S. Application Data continuation of application No. 14/867,082, filed on Sep. 28, 2015, now Pat. No. 9,919,201, which is a continuation of application No. 12/092,548, filed as application No. PCT/US2008/054146 on Feb. 15, 2008, now abandoned.

(60) Provisional application No. 60/890,328, filed on Feb. 16, 2007, provisional application No. 60/943,171, filed on Jun. 11, 2007, provisional application No. 61/012,230, filed on Dec. 7, 2007, provisional application No. 61/020,470, filed on Jan. 11, 2008, provisional application No. 61/023,290, filed on Jan. 24, 2008, provisional application No. 61/024,827, filed on Jan. 30, 2008, provisional application No. 61/028,555, filed on Feb. 14, 2008.

(51) Int. Cl.
*G07F 17/32* (2006.01)
*A63F 1/00* (2006.01)
*A63F 1/14* (2006.01)

(52) U.S. Cl.
CPC ..... *A63F 1/14* (2013.01); *G07F 1/06* (2013.01); *G07F 17/32* (2013.01); *G07F 17/322* (2013.01); *G07F 17/3232* (2013.01); *G07F 17/3251* (2013.01); *A63F 2001/001* (2013.01)

(56) References Cited

U.S. PATENT DOCUMENTS 3,834,712 A 9/1974 Cox
4,605,053 A 8/1986 Fricke
4,648,600 A 3/1987 Olliges
4,814,589 A 3/1989 Storch
4,856,787 A 8/1989 Itkis
4,862,041 A 8/1989 Jones et al.
5,098,107 A 3/1992 Boylan et al.
5,248,142 A 9/1993 Breeding
5,265,882 A 11/1993 Malek
5,275,416 A 1/1994 Schorr et al.
5,280,915 A 1/1994 Groussman
5,283,422 A 2/1994 Storch
5,342,049 A 8/1994 Wichinsky et al.
5,367,148 A 11/1994 Storch
5,390,934 A 2/1995 Grassa
5,511,781 A 4/1996 Wood et al.
5,544,893 A 8/1996 Jones
5,566,946 A 10/1996 Parker
5,570,885 A 11/1996 Ornstein
5,615,888 A 4/1997 Lofink et al.
5,632,485 A 5/1997 Woodland et al.
5,651,548 A 7/1997 French et al.
5,702,106 A 12/1997 Alvarez
5,735,742 A * 4/1998 French ..... A63F 1/06 463/25
5,743,800 A 4/1998 Huard
5,788,574 A 8/1998 Ornstein et al.
5,806,846 A 9/1998 Lofink et al.
5,816,575 A 10/1998 Keller
5,831,527 A 11/1998 Jones, II
5,851,010 A 12/1998 Feinberg
5,911,418 A 6/1999 Adams
5,947,822 A 9/1999 Weiss
5,954,335 A 9/1999 Moody
5,961,384 A 10/1999 Robinson
5,964,463 A 10/1999 Moore et al.
5,992,316 A 11/1999 Coyle et al.
6,019,374 A 2/2000 Breeding
6,089,976 A 7/2000 Schneider et al.
6,102,400 A 8/2000 Scott et al.
6,120,377 A 9/2000 McGinnis et al.
6,129,632 A 10/2000 Luciano
6,186,895 B1 2/2001 Oliver
6,203,429 B1 3/2001 DeMar et al.
6,213,876 B1 4/2001 Moore, Jr.
6,217,447 B1 4/2001 Lofink et al.
6,227,969 B1 5/2001 Yoseloff
6,231,442 B1 5/2001 Mayeroff
6,286,834 B1 9/2001 Caputo
6,305,686 B1 10/2001 Perrie et al.
6,309,300 B1 10/2001 Glavich
6,315,660 B1 11/2001 DeMar et al.
6,322,309 B1 11/2001 Thomas et al.
6,334,814 B1 1/2002 Adams
6,336,863 B1 1/2002 Baerlocher et al.
6,341,778 B1 1/2002 Lee
6,358,147 B1 3/2002 Jaffe et al.
6,371,867 B1 4/2002 Webb
6,375,190 B1 4/2002 Kocher
6,375,567 B1 4/2002 Acres
6,379,245 B2 4/2002 DeKeller
6,406,023 B1 6/2002 Rowe
6,409,172 B1 6/2002 Vancura
6,450,884 B1 9/2002 Seelig et al.
6,454,266 B1 9/2002 Breeding et al.
6,506,118 B1 1/2003 Baerlocher et al.
6,508,707 B2 1/2003 DeMar et al.
6,598,879 B2 7/2003 Spur et al.
6,599,192 B1 7/2003 Baerlocher et al.
6,602,136 B1 8/2003 Baerlocher et al.
6,619,662 B2 9/2003 Miller
6,663,498 B2 12/2003 Adams
6,679,492 B2 1/2004 Markowiak
6,679,497 B2 1/2004 Walker et al.
6,682,421 B1 1/2004 Rowe et al.
6,685,560 B1 2/2004 Hughes
6,726,564 B2 4/2004 Hogan et al.
6,743,102 B1 6/2004 Fiechter et al.
6,749,200 B2 6/2004 Yurkins
6,758,748 B2 7/2004 Byrne
6,786,824 B2 9/2004 Cannon
6,802,774 B1 10/2004 Carlson et al.
6,852,031 B1 2/2005 Rowe
6,855,051 B1 2/2005 Mostashari
6,877,746 B1 4/2005 Herren et al.
6,893,342 B1 5/2005 Singer et al.
6,929,264 B2 8/2005 Huard et al.
7,093,833 B1 8/2006 Horning
7,144,011 B2 12/2006 Asher
7,561,053 B2 * 7/2009 Hecht ..... G07F 17/32 340/572.1
7,654,532 B2 2/2010 Feola
7,722,047 B2 5/2010 Walker et al.
7,852,223 B2 12/2010 Hecht
7,922,587 B2 4/2011 Chun
7,938,722 B2 * 5/2011 Rowe ..... A44C 21/00 463/29
8,087,985 B2 1/2012 Katz
8,146,829 B2 * 4/2012 Frost ..... A44C 21/00 235/491
8,608,548 B2 * 12/2013 Mattice ..... G07F 17/3251 463/25
2002/0002072 A1 1/2002 Sines et al.
2002/0190470 A1 12/2002 Alaeddin
2003/0195043 A1 10/2003 Shinners et al.
2004/0207156 A1 10/2004 Soltys et al.
2005/0035548 A1 2/2005 Yoseloff et al.
2005/0143157 A1 6/2005 Stelzer et al.
2006/0046853 A1 3/2006 Black
2006/0131809 A1 6/2006 Lancaster
2006/0258446 A1 * 11/2006 Nguyen ..... G07F 17/32 463/30
2006/0287068 A1 12/2006 Walker
2007/0032283 A1 2/2007 Chun
2007/0087834 A1 * 4/2007 Moser ..... G07F 17/3237 463/42
2007/0090598 A1 4/2007 Regos
2007/0194931 A1 8/2007 Miller
2007/0281786 A1 12/2007 Kuhn et al.
2008/0067745 A1 3/2008 Wikstrom

(56) References Cited

U.S. PATENT DOCUMENTS

| | | | | |
|---|---|---|---|---|
| 2008/0108401 | A1 | 5/2008 | Baerlocher | |
| 2008/0113772 | A1 | 5/2008 | Burrill et al. | |
| 2010/0093428 | A1* | 4/2010 | Mattice | G07F 17/3251 463/25 |
| 2018/0193726 | A1 | 7/2018 | Walker | |

OTHER PUBLICATIONS

Office Action for U.S. Appl. No. 12/092,548 dated Dec. 6, 2012; 12 pps.
Final Office Action for U.S. Appl. No. 12/092,548 dated Jul. 3, 2013; 13 pps.
Office Action for U.S. Appl. No. 12/092,548 dated Mar. 27, 2014; 14 pps.
Appeal Brief for U.S. Appl. No. 12/092,548 dated Oct. 23, 2014; 40 pps.
Reply Brief for U.S. Appl. No. 12/092,548 dated Feb. 12, 2015; 10 pps.
Examiner's Answer to Appeal Brief for U.S. Appl. No. 12/092,548 dated Dec. 12, 2014; 15 pps.
Certificate of Invention Patent for Chinese Application No. 200880012338.1 dated Mar. 25, 2015; 51 pps.
Certificate of Grant of Patent and Notification of Grant for Singapore Application No. 2012010427 dated Jun. 22, 2015; 1 pps.
Notice of Grant for Australian Application 2012202968 dated Jun. 12, 2014; 2 pps.
Notice of Grant for Malaysian Application PI 20093412 dated Apr. 2, 2018; 72 pps.
Office Action for U.S. Appl. No. 14/867,082 dated Jun. 21, 2017; 10 pps.
Notice of Allowance for U.S. Appl. No. 14/867,082 dated Nov. 15, 2017; 5 pps.
Office Action for U.S. Appl. No. 15/916,117 dated Apr. 11, 2019; 5 pps.
Notice of Allowance for U.S. Appl. No. 15/916,117 dated Jul. 29, 2019; 5 pps.
International Search Report for Serial No. PCT/US08/54146 dated Jul. 14, 2008; 2 pps.
Written Opinion for Serial No. PCT/US08/54146 dated Jul. 14, 2008; 6 pps.
International Search Report for Serial No. PCT/US11/039483 dated Oct. 20, 2011; 2 pps.
Written Opinion for International Search Report for Serial No. PCT/US11/039483 dated Oct. 20, 2011; 8 pps.
Office Action for U.S. Appl. No. 12/255,222 dated Sep. 23, 2011; 13 pps.
Australian Patent Examination Report No. 1 for Application No. 201165034 dated Sep. 17, 2013, 3 pp.
Singapore Intellectual Property Office Written Opinion for Application No. 201205094-4 dated Jul. 10, 2013, 5 pp.
Chinese Intellectual Patent Office Action and Search Report for Application No. 20080012338.1 dated Aug. 5, 2013, 11 pp.
European Search Report for Application No. 08730031.5 dated Apr. 11, 2013, 7 pp.
Singapore Intellectual Property Office Search Report for Application No. 201201042.7 dated Jul. 16, 2013, 6 pp.
Hawley, David, '"Survival Dice' is Coward Craps", Saint Paul Pioneer Press, Jan. 28, 1995, Section: Express; You Betcha!, 2 pp.
Aim, Rick, "Casino industry gets advice on marketing", Kansas City Star, Oct. 15, 1996, Section: Johnson County/Metro, 4 pp.
Grochowski, John, "1996 brought new casinos, new games", Chicago Sun-Times,Dec. 29, 1996, Section Show; Casinos, 2 pp.
McCartney, Jim, "In Search of Simplicity", International Gaming and Wagering Business, Aug. 1997; 4 pps.
"Games Will be Introduced at World Gaming Congress & Expo in Las Vegas", PR Newswire, Oct. 10, 1997; 2 pps.
Reid, Paul, "The Gambler & The Sea", The Palm Beach Post, Apr. 14, 1998; 5 pps.
Berns,Dave, "Pass Go, Collect Millions", Las Vegas Review—Journal, Sep. 28, 1998; 2 pps.
Rosenberg, Amy S., "At Casinos 'Easy' Games are Big Hits / Simplicity is Key, But Getting A.C. to Buy into New Ways to Play is Not So Simple. Still, An Area Man is Trying His Hand." The Philadelphia Inquirer, Jun. 14, 1999; 3 pps.
Grochowski, John, "Game-maker rolls out Monopoly, Yatzee Coast to Coast trip showcases small-town America", Chicago Sun-Times, Oct. 21, 1999; 3 pps.
Grochowski, John "Monopoly Blackjack packs jackpot surprise", Chicago Sun-Times, May 25, 2001; 2 pps.
Grochowski, John, "A Jackpot hunter's guide to Caribbean Stud", Chicago Sun-Times, Jan. 27, 2002; 2 pps.
Baron, Neil, "Games People Play", Reno Gazette-Journal, Jun. 20, 2002; 4 pps.
"New Bingo Platform form Boss Media; Boss Media, Europe's Leading Digital Gaming Software Company, Launches Online Bingo", PrimZone Media Network, Nov. 7, 2002; 2 pps.
Website: "Big Top Circus", Sigma Game, Inc. (http//www.sigmagame.com/bigtopcircus2.html), download date: Oct. 4, 2004; 4 pps.
Office Action for U.S. Appl. No. 10/121,251 dated Oct. 5, 2011; 18 pps.
Office Action for U.S. Appl. No. 10/121,251 dated Mar. 3, 2011; 16 pps.
Office Action for U.S. Appl. No. 10/121,251 dated Jul. 6, 2010; 20 pps.
Office Action for U.S. Appl. No. 10/121,251 dated Apr. 27, 2009; 13 pps.
Office Action for U.S. Appl. No. 10/121,251 dated Aug. 14, 2008; 11 pps.
Office Action for U.S. Appl. No. 10/121,251 dated Dec. 20, 2007; 11 pps.
Office Action for U.S. Appl. No. 10/121,251 dated May 18, 2007; 13 pps.
Office Action for U.S. Appl. No. 10/121,251 dated Nov. 24, 2006; 6 pps.
Office Action for U.S. Appl. No. 10/121,251 dated Oct. 14, 2005; 15 pps.
Office Action for U.S. Appl. No. 10/121,251 dated Apr. 26, 2005; 12 pps.
Office Action for U.S. Appl. No. 10/121,251 dated Nov. 4, 2004; 12 pps.
Office Action for U.S. Appl. No. 10/121,251 dated Apr. 7, 2004; 7 pps.
Office Action for U.S. Appl. No. 12/032,361 dated Feb. 15, 2008; 8 pps.
Office Action for U.S. Appl. No. 11/422,356 dated Aug. 17, 2007; 6 pps.
Office Action for U.S. Appl. No. 11/422,356 dated Mar. 14, 2007; 5 pps.
Office Action for U.S. Appl. No. 11/422,353 dated Mar. 14, 2007; 5 pps.
Office Action for U.S. Appl. No. 11/422,358 dated Aug. 17, 2007; 5 pps.
Office Action for U.S. Appl. No. 11/422,358 dated Mar. 14, 2007; 5 pps.
U.S. Appl. No. 10/121,251 application as filed Apr. 11, 2002; 45 pps.
U.S. Appl. No. 13/042,633 entitled "A Betting Terminal And System" filed Mar. 8, 2011; 23 pps.
Office Action for U.S. Appl. No. 12/255,222 dated Mar. 7, 2012; 15 pps.
Supplemental European Search Report for Application No. 08730031.5 dated Jun. 29, 2012, 7 pp.
Australian Patent Examination Report for Australian Patent Application No. 2012202958 dated Jan. 11, 2013; 7 pps.
Restriction Requirement Office Action for U.S. Appl. No. 12/092,548 dated Nov. 24, 2010; 6 pps.
Office Action for U.S. Appl. No. 12/092,548 dated Mar. 18, 2011; 11 pps.

(56) References Cited

OTHER PUBLICATIONS

Final Office Action for U.S. Appl. No. 12/092,548 dated Nov. 21, 2011; 7 pps.

* cited by examiner

| PLAYER | BANKER |
|---|---|
| 4 | 2 |

(NUMBERS SHOWN ARE PAYS IN ADDITION TO RETURNED WAGER ON WIN; IN CASES WHERE TIE IS ALLOWED, TIE RETURNS FULL WAGER)

| | | TOTAL BET (EVEN MONEY) | UNRATED (8% EDGE) | | GOLD (5% EDGE) | | PLATINUM (3% EDGE) | | DIAMOND (2% EDGE) | |
|---|---|---|---|---|---|---|---|---|---|---|
| | | | PLAYER | BANKER | PLAYER | BANKER | PLAYER | BANKER | PLAYER | BANKER |
| 1 | PRESS | 2,000 | 1,500 | 1,845 | 1,615 | 2,000 | 1,695 | 2,100 | 1,730 | 2,155 |
| 2 | SWITCH & PRESS | 2,000 | 2,595 | 930 | 2,745 | 1,045 | 2,850 | 1,125 | 2,820 | 1,105 |
| 3 | SWITCH | 1,000 | 1,455 | 305 | 1,530 | 360 | 1,580 | 400 | 1,605 | 420 |
| 4 | PRESS | 1,000 | 1,150 | 460 | 1,220 | 525 | 1,265 | 570 | 1,285 | 590 |
| 5 | TWO IN A ROW | 1,000 | 2,600 | 2,260 | 2,730 | 2,425 | 2,820 | 2,535 | 2,860 | 2,590 |
| 6 | NO TIES | 1,000 | 1,055 | 955 | 1,110 | 1,030 | 1,150 | 1,080 | 1,170 | 1,105 |
| 7 | WIN BIG (2+) | 1,000 | 1,485 | 1,530 | 1,555 | 1,625 | 1,600 | 1,695 | 1,625 | 1,725 |
| 8 | WIN GIANT (4+) | 1,000 | 3,950 | 3,775 | 4,090 | 3,960 | 4,185 | 4,085 | 4,230 | 4,150 |
| 9 | QUICK 2 | 1,000 | 3,845 | 3,460 | 4,040 | 3,650 | 4,170 | 3,780 | 4,235 | 3,845 |
| ##### | LATE PAIR | 1,000 | 5,855 | 3,965 | 6,050 | 4,160 | 6,180 | 4,290 | 6,245 | 4,355 |
| ##### | TIES WIN | 1,000 | 735 | 570 | 780 | 635 | 815 | 675 | 830 | 695 |
| ##### | TAKE DOWN | 500 | 475 | -390 | 590 | -240 | 670 | -135 | 710 | -85 |
| ##### | SELL | 1,000 | 55 | -235 | 85 | -205 | 105 | -185 | 115 | -175 |

FIG. 9

RFID SYSTEM FOR FACILITATING SELECTIONS AT A TABLE GAME APPARATUS

PRIORITY CLAIM

This application is a Continuation of U.S. application Ser. No. 15/916,117, filed on Mar. 8, 2018 in the name of Jay S. Walker and entitled RFID SYSTEM FOR FACILITATING SELECTIONS AT A TABLE GAME APPARATUS, which application is a Continuation of U.S. application Ser. No. 14/867,082, filed on Sep. 28, 2015 in the name of Jay S. Walker and entitled RFID SYSTEM FOR FACILITATING SELECTIONS AT A GAME APPARATUS (which issued as U.S. Pat. No. 9,919,201 on Mar. 20, 2018) and which application is, in turn, a Continuation of U.S. application Ser. No. 12/092,548 filed on Aug. 21, 2008 in the name of Jay S. Walker et al. and entitled RE-CHARACTERIZATION OF BETS AT TABLE GAMES. U.S. application Ser. No. 12/092,548 claims the benefit and priority of (i) PCT Application No. PCT/US08/54146, filed on Feb. 15, 2008, entitled Recharacterization of Bets at Table Games; (ii) U.S. Provisional Patent Application Ser. No. 60/917,196, filed on May 10, 2007, entitled Systems, Methods, and Apparatus for Additional Game Options in Blackjack, Baccarat and Other Games; and (iii) U.S. Provisional Patent Application Ser. No. 60/939,263, filed on May 21, 2007, entitled Systems, Methods, and Apparatus for Additional Game Options in Blackjack, Baccarat and Other Games. PCT Application No. PCT/US08/54146 claims the benefit of (i) U.S. Provisional Patent Application Ser. No. 61/024,827, filed Jan. 30, 2008, entitled Recharacterization of Bets at Table Games; (ii) U.S. Provisional Patent Application Ser. No. 61/023,290, filed Jan. 24, 2008, entitled Recharacterization of Bets at Table Games; (iii) U.S. Provisional Patent Application Ser. No. 61/020,470, filed Jan. 11, 2008, entitled Method and Apparatus for Playing Baccarat with Late Play Options; (iv) U.S. Provisional Patent Application Ser. No. 61/012,230, filed Dec. 7, 2007, entitled Table Game Session Play; (v) U.S. Provisional Patent Application Ser. No. 60/943,171, filed Jun. 11, 2007, entitled Blackjack Session Play; (vi) U.S. Provisional Patent Application Ser. No. 60/890,328, filed Feb. 16, 2007, entitled Systems and Method for Conducting Casino Games; and (vii) U.S. Provisional Patent Application Ser. No. 61/028,555, filed Feb. 14, 2008, entitled Proposition Bets for Baccarat and Other Games. Each of these identified applications is hereby incorporated by reference in its entirety and for all purposes.

RELATED APPLICATIONS

The present application is also related to the following patent applications:

PCT patent application Serial No. PCT/US0779518, filed Sep. 26, 2007; and

U.S. patent application Ser. No. 11/735,231, filed Apr. 13, 2007, entitled Incremental Revelation of Results in a Game of Chance.

Each of these applications is hereby incorporated by reference in its entirety.

FIELD OF THE INVENTION

The present invention is directed to a way to increase betting options in table games.

BRIEF DESCRIPTION OF THE DRAWINGS

FIG. 9 illustrates an exemplary page from a look up table.

DETAILED DESCRIPTION OF THE INVENTION

Figure 1:
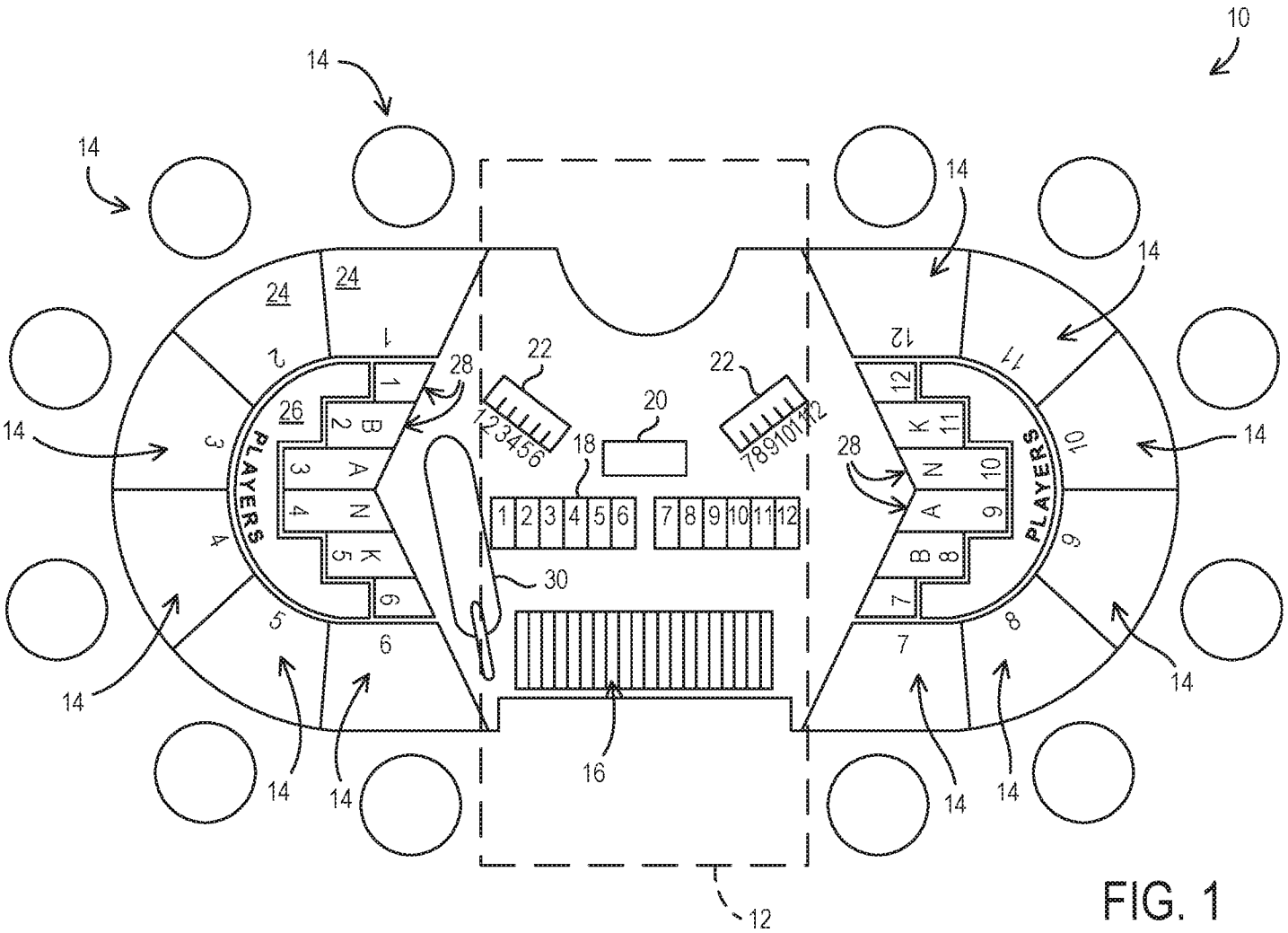
FIG. 1 PRIOR ART
FIG. 1 illustrates a top plan view of a traditional baccarat table.

Games like baccarat and blackjack are generally considered low volatility, static games. Because the volatility is so low, players may play for hours and not incur substantial gambling losses relative to the size of the player's average wager. Conversely, gaming establishments that provide such games enjoy a relatively low house advantage, which may vary from 0.5% to 2.5% depending on the precise rule set in place for the game and/or player strategy. While Blackjack allows players to make some decisions during game play, these decisions are strictly limited. Baccarat goes even further and allows no decision after the player has decided whether to bet on the banker hand or the player hand. While the limitations on decision making helps preserve the low volatility, there may be times where a player may wish that a rule variant existed so that the player could feel more involved in the game. Gaming establishments may likewise desire to provide these opportunities, albeit at a higher margin.

Embodiments of the present disclosure allow for such opportunities through the use of a concept termed herein "bet re-characterization". After a player places an initial bet within a game, the player is afforded the opportunity to change the criterion by which the initial bet is determined to be a winning bet or a losing bet. In exchange for the right to make this change, the house may increase the house advantage for the re-characterized bet.

An example using baccarat is illustrative. In baccarat, a bettor places an initial wager on either the player hand or the banker hand, depending on which hand the bettor thinks will win. The bettor, for this example, bets on the player station. The dealer deals two cards (e.g., two-jack) to the player station and two cards (e.g., four-ace) to the banker position to form an intermediate result (e.g., the player has a 2 and the banker has a 5) short of a final resolution of the game instance. That is, the rules of the game dictate that, in this circumstance additional cards are drawn by one or both hands. Based on the cards currently shown, the bettor decides to re-characterize her bet such that the bet is no longer a bet on the player station winning. In particular, daunted by the odds of beating a dealer five, the player re-characterizes her bet so that the changed bet is that the player will have a pair (either two jacks or two twos). The bettor places a re-characterization token on the stack of chips representing her wager (the token might be labeled "Pair"). By re-characterizing the wager, the bettor replaces the original wager with the re-characterized wager. The game is resolved with the player station receiving a hit card (e.g., a four, for a total of 6). Under this fact pattern, the banker also takes a hit (e.g., a nine, for a total of 4). Normally, bettors betting on the player station would win because the player score (6) beats the banker score (4). However, because the bettor had re-characterized her bet into a pair bet, the bettor loses. Assume instead that the player drew a 2, for a total of 4. The banker stands on his five since the player draw card was a two. Normally, the bettor would lose a bet on the player station, but because the bettor had re-characterized her bet to have a pair, the bettor would win.

While the pair bet is one form of bet re-characterization, there are numerous other events within the game to which the player may re-characterize her bet. Note also that in this example, the re-characterized bet supersedes the original bet. There are other forms of bet re-characterization discussed in greater detail below such as where the re-characterization bet subsumes the original bet, or splits into a partial original bet and a new bet. As yet another alternative, instead of a re-characterized bet, the new bet may be offered as a side bet or second bet. In any of these situations, the odds may be adjusted to give the house a more favorable house advantage, a less favorable house advantage, or maintain the normal house advantage as desired.

Various systems may be deployed to provide bet re-characterization and several examples are provided below. The present disclosure will focus on baccarat as an example, but it should be appreciated that bet re-characterization may be applied to other table games such as blackjack, roulette, craps, Sic Bo, Pai Gow (tile and poker variations), LET IT RIDE™, CARIBBEAN STUD™, 3-CARD POKER, 4-CARD POKER, SPANISH 21, variants of these games (e.g., Chemin de Fer), or the like.

Simple Table

The rules of baccarat are well understood, but the interested reader is directed to www.wizardofodds.com/baccarat for a more detailed explanation. Turning now to FIG. 1, an embodiment that is relatively simple to implement is presented. FIG. 1 illustrates a traditional baccarat table 10 with a dealer station 12 and a plurality of player stations 14. The dealer station 12 is sized to accommodate two dealers, one on either side. Many high roller style baccarat tables actually have three dealers present, and the dealer station 12 may provide room for the number of dealers assigned to the table. The dealer station 12 has a chip rack 16, as well as commission indicia 18, bank hand area 20, and tie bet indicia 22. The chip rack 16 is sized to accommodate chips and plaques as is well understood. The commission indicia 18 allow the house to keep a record of any commissions that the player may owe for betting on the banker hand. Players usually settle the commission at the end of the shoe and/or before leaving the table so as to minimize disruption of game play. As illustrated, commission indicia 18 are divided into boxes for each player station. The banker hand area 20 is the place to which the cards forming the banker hand are dealt. The tie bet indicia 22 are the locations on the table where a player may indicate a wager on a tie between the banker hand and the player hand. Again, the tie bet indicia 22 are divided so that there is a box for each player station. While the tie bet indicia 22 may conceptually be thought of as part of the player stations 14, the positioning of the tie bet indicia 22 in the center of the table makes it impractical for a player to position a wager therein, so in most instances, the dealer will position such a wager, and thus, for the purposes of the present disclosure, the tie bet indicia 22 are included within the dealer station 12. While not illustrated in FIG. 1, some baccarat tables have display panels that indicate historical outcomes. Players sometimes use such historical outcomes in an effort to predict trends within a stream of game instances.

Each player station 14 includes a chip area 24 where the player may position her chips. A player bet area 26 exists in front of each chip area 24. As illustrated, the player bet area 26 is not specifically delimited for each player station, but such indicia are sometimes present. Additionally, each player station 14 includes a bank bet area 28 with appropriate indicia to link wagers placed therein to a particular player station 14. The dealers may use a shoe (not shown) to hold cards and a paddle or wand 30 to move cards and/or chips to particular locations on the table 10 as is well understood.

Figure 2:
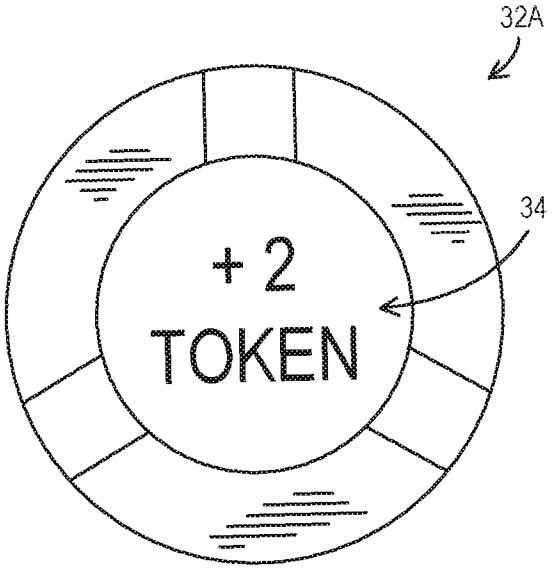

At least some embodiments of the present disclosure may operate on such a simple table 10. These embodiments use a bet re-characterization token to indicate that a bet has been re-characterized by a player. Exemplary re-characterization tokens 32A-32D (generically re-characterization tokens 32) are illustrated in FIGS. 2-5. FIG. 2 illustrates a very simple embodiment of the re-characterization token 32A with bet re-characterization indicia 34 thereon. The bet re-characterization indicia 34 includes enough information to inform the viewer what re-characterization bet is denoted by the token 32A. In the illustrated embodiment, the re-characterization is a "+2" re-characterization. More information on the various re-characterizations possible is set forth below.

Figure 3:
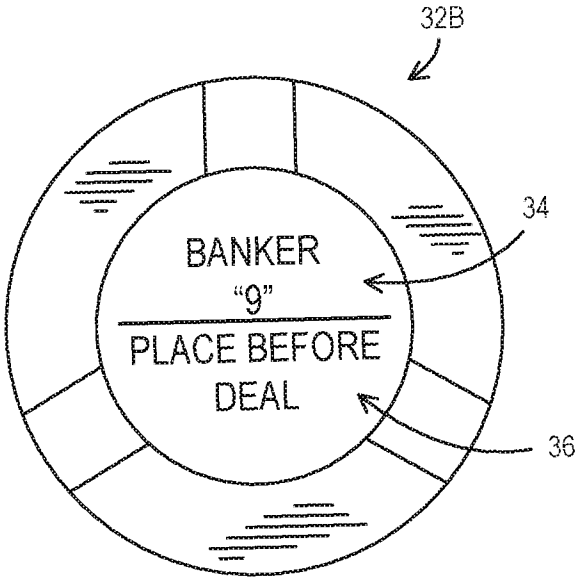
FIGS. 2-5 illustrate various re-characterization tokens and indicia used thereon to denote various types of re-characterization activity.

The re-characterization token 32B of FIG. 3 includes the re-characterization indicia 34, which, in this embodiment are indicia indicating that the token is a "banker nine" re-characterization token, as well as rule indicia 36 which may set forth rules that are applied to use of the token. For example, as illustrated, the rule is that the token 32B must be placed before the deal. Other rules may be imposed on use of the tokens 32 as will be further explained below.

Figure 5:
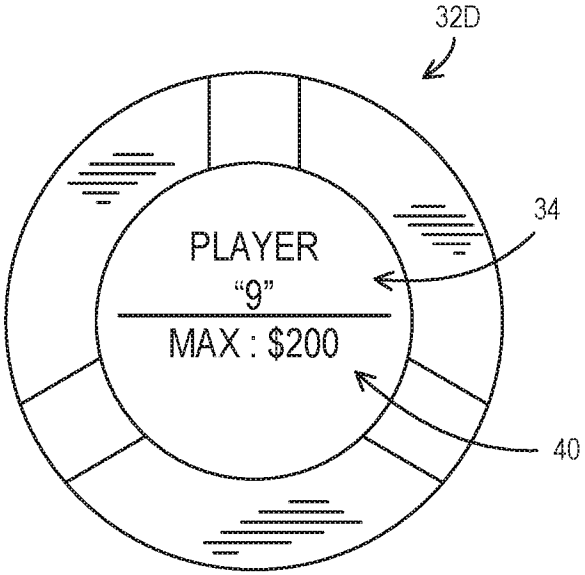
Figure 4:
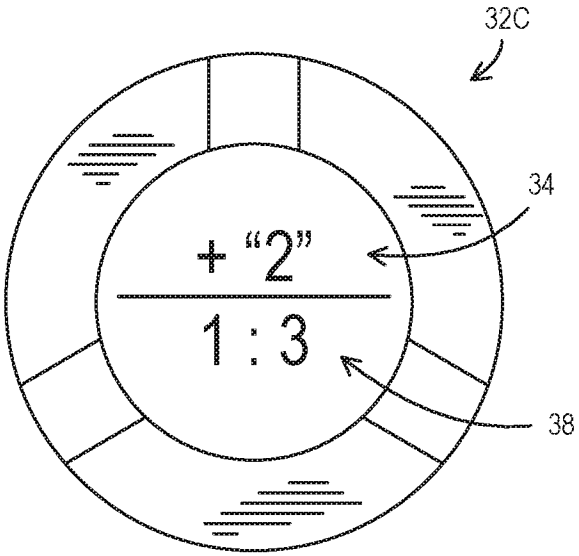

Instead of a rule on use of the token, a rule on payouts may be provided on the tokens 32. Token 32C (FIG. 4) has odds indicia 38 disposed thereon. Likewise FIG. 5 illustrates token 32D which has max bet indicia 40 disposed thereon.

While illustrated as something that looks like a chip or coin, it should be understood, that as used herein, the term "token" is defined to be a physical element capable of bearing indicia indicating a bet re-characterization. Specifically included tokens include chips, coins, markers, lammers, buttons, cards (perhaps uniquely marked), dice, tickets, or other paper substrate, a ring, a bowl, a chip tray or sleeve, a chip clip, and charms. The indicia may be textual, graphical, color-coded, or the like. For example, a blue button may denote a first type of bet re-characterization and a red button a second type of bet re-characterization. Color codes could be published and understood by the public in much the same manner that chip color codes denote value and are understood by the public (e.g., green=twenty-five dollars). More esoteric tokens are described in greater detail in the alternate embodiment section below.

Figure 6:
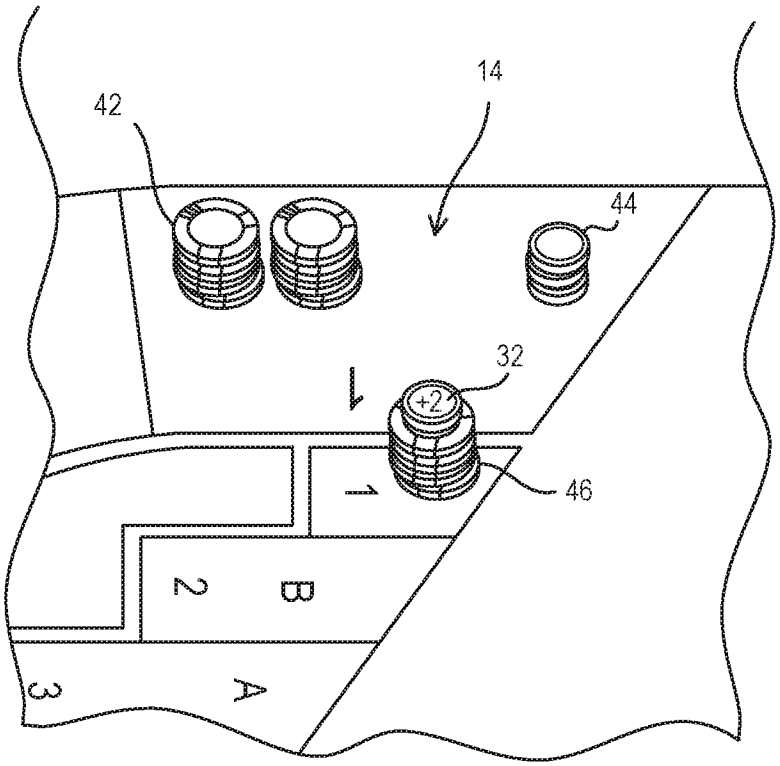
FIG. 6 illustrates a bet re-characterization token in use on a wager.

Returning to the table 10 in FIG. 6, use of a token 32 is illustrated. In particular, a player at player station one has a stack of reserve chips 42 from which the player makes wagers. The player also has a stack 44 of tokens 32 from which the player may select an individual token 32 to re-characterize a bet. The player has placed a wager stack 46 on the banker hand and has denoted that this wager is a re-characterized wager by placing a token 32 on top of the wager stack 46. While illustrated as being on top of the wager stack 46, the token 32 may be placed underneath, beside, in the middle of, or otherwise be associated with the wager stack 46 to denote the re-characterization of the wager stack 46.

The cards are dealt as normal, and re-characterized bets at a first player station do not affect normal wagers at other player stations. Thus, in this simple embodiment, no changes are specifically required to the table, so a player may approach the table, see a table layout with which she is familiar, and begin play without the game appearing to be a new game.

Figure 7:
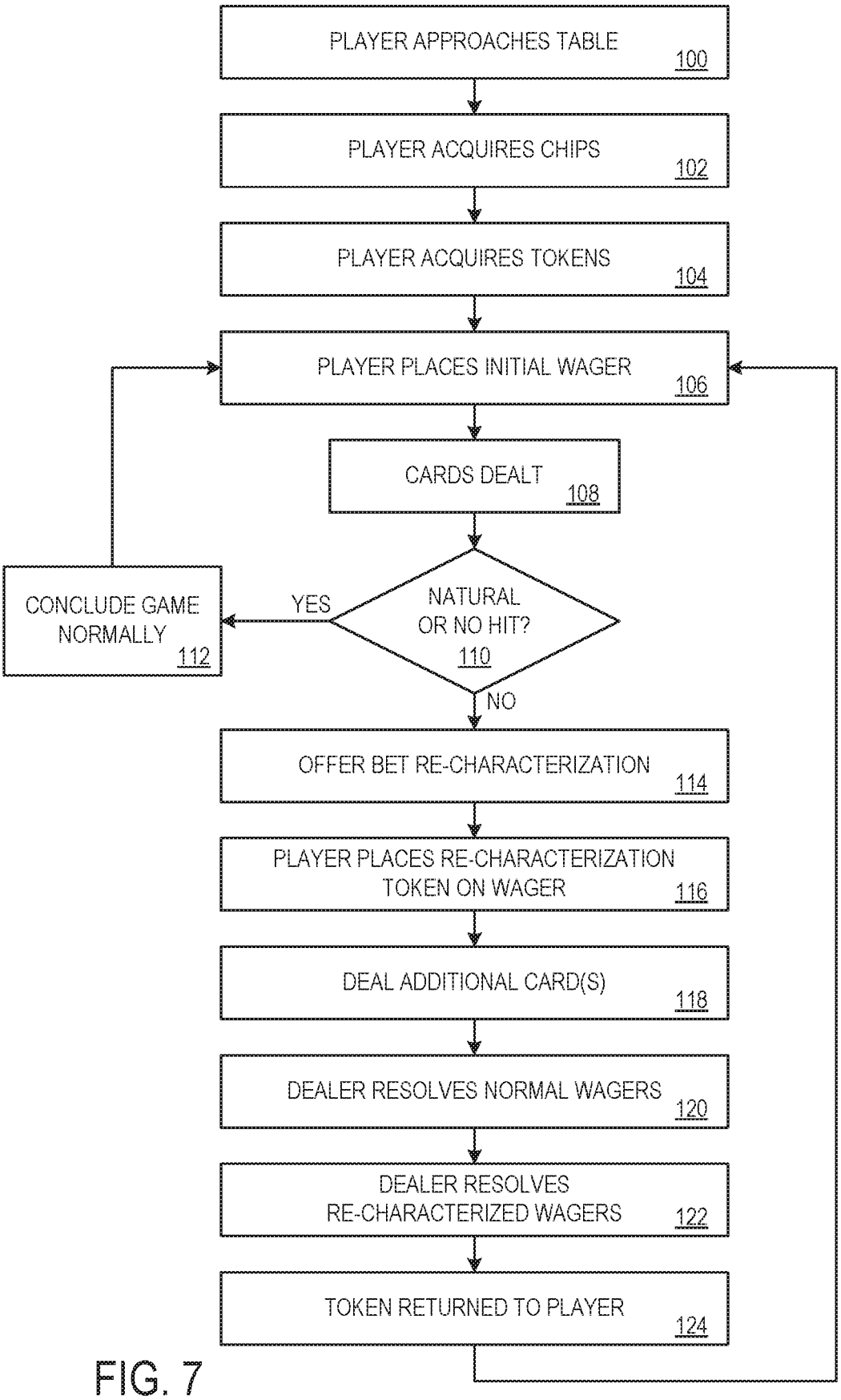
FIG. 7 illustrates a flow chart showing an exemplary method of use of a bet re-characterization token.

Against this backdrop of physical elements, a brief description of the flow of the game is provided with reference to FIG. 7. The gaming establishment may conduct game play as follows. The player initially approaches the table 10 (block 100). The player acquires chips from the dealer as is normal (block 102). Note that in some instances, the player may acquire chips before approaching the dealer. The player likewise acquires bet re-characterization tokens 32 from the dealer (block 104). Various other ways of acquiring re-characterization tokens 32 are described in greater detail below. When the dealer signals that new bets are being accepted, the player places an initial wager (block 106). The player does this by placing one or more chips (e.g., wager stack 46) in the player bet area 26 or the bank bet area 28 as is well understood. Two cards are dealt to the player station with the highest player hand wager and two cards are dealt to the banker hand area 20 (block 108). The cards are turned over so that everyone sees the cards. Turning the cards over is sometimes referred to as "squeezing" the cards. A determination is made whether either hand is a "natural" (i.e., an eight or nine) or whether both hands are pat hands (i.e., the player hits on a hand of five or less and, if the player stands, the banker hits on a five or less, so dealt hands of six-six, seven-seven, six-seven, or seven-six are pat hands (note that a dealer may take a card on a banker score of six if the player is dealt a six or seven as the player's third card—again, the interested reader is directed to the baccarat rules at www.wizardofodds.com for a complete explanation of the stand/hit rules)) (block 110). If the answer to block 110 is yes, someone has a natural or there will be no hit card, then the game instance is concluded normally (block 112) according to well understood rules.

If, however, the answer to block 110 is no, someone will take a hit, then the dealer (or other person) may indicate that the table will accept bet re-characterizations at this time (block 114). If a player desires to re-characterize her bet, the player places a re-characterization token 32 on the wager stack 46 (block 116) as illustrated in FIG. 6. The dealer then deals additional card(s) to the appropriate hand(s) as indicated by the well understood rules of baccarat (block 118). The dealer resolves normal wagers (i.e., those that have not been re-characterized) using the normal payout rules for baccarat (block 120), marking any commissions within the commission indicia 18. The dealer then resolves any wagers that have been re-characterized (block 122). Special procedures may be provided for payouts associated with re-characterized wagers as described in greater detail below. Likewise, the odds for the re-characterized wagers may be different than 1:1 or 0.95:1 as is common in baccarat, so the amount of the payout may need to be calculated. Again, more information on this procedure is provided below. The re-characterization token 32 may be returned to the player (block 124), and play repeats as indicated. Note that the dealer may resolve normal and re-characterized wagers in the opposite order, or may resolve them concurrently as desired. The precise order of resolution is not central to the present disclosure. Likewise, the flow chart of FIG. 7 does not specifically address how commissions are handled, but any technique for handling commissions is contemplated.

An alternate embodiment also within the scope of the present disclosure is to vary when bet re-characterizations may take place. Instead of offering bet re-characterization after the first four cards are dealt and revealed, the result of the initial deal could be revealed incrementally and bet re-characterization may be offered after each card was revealed. As yet another alternative, the bet re-characterization may take place before the first card is dealt (e.g., before play begins, a player places a token that provides an option, whether exercised by the player or activated conditionally by a set of rules, to re-characterize a bet during an intermediate stage of the game). Some games, such as baccarat and blackjack, have "natural" granularity in this regard, as it is common for cards to be dealt one at a time (thus presenting many opportunities or stages for re-characterization). Other games, such as roulette, do not normally feature such staged outcome revelation, though they may be designed to do so. For more information about parsing an outcome into incremental intermediate revelation events, the interested reader is directed to previously incorporated U.S. patent application Ser. No. 11/735,231.

Acquiring Re-Characterization Tokens

In a first embodiment, bet re-characterization tokens 32 are free and have no monetary value. Players may be issued such tokens 32 at a table from the dealer as needed and may be required to return the tokens 32 before leaving the table. The tokens 32 may have further indicia (not shown) which associates or assigns particular tokens 32 to particular player stations 14 to facilitate tracking the tokens 32 (e.g., a token 32 may state "Player station 1" to indicate that it belongs to that player station or may state "Table TK342 to indicate that it belongs to a particular gaming table). In one embodiment, a player may receive tokens as a set (e.g., a bundle, package, or group that includes one each of five different types of re-characterization tokens). In another embodiment, a player may request a specific, individual token. In other embodiments, players may not handle tokens (either dealers may handle the tokens at the request of players as described below, or physical tokens may not be utilized, such as when the game is conducted at an entirely electronic or virtual table). Alternatively, tokens 32 may be received from a kiosk, vending machine, a cashier's cage, player's club, or other location as desired.

As yet another alternative, the tokens 32 may be purchased before or while a player sits at a table 10. In such an embodiment, the tokens 32 may have a cash value for which the token 32 may be redeemed (or they may not—tokens are purchased, and then must be used or forfeited). Tokens 32 that represent different types of bet re-characterizations may cost different amounts. Likewise, tokens 32 that have different rules may cost different amounts. Various rules might be odds (e.g., a first "pair" bet token 32 may pay 1:1 and cost five dollars. Another may pay 2:1 and cost twenty dollars), size of wager (tokens 32 covering bets under five hundred dollars cost $10 and those covering bets over five hundred dollars cost $50), or the like. If the token 32 is sold to the player during game play, the cost of the token 32 may reflect the conditions of the active game instance and may require that the token 32 be played in that game instance (e.g., a win by 2 re-characterization token costs $20 when player is ahead, but is free when player is behind). For the sake of simplicity, many of the examples used herein are even amounts. It is to be understood that a precise calculation of values may result in an uneven amount.

In yet another embodiment, the tokens 32 may be provided as a comp, as a promotion, or as part of a retail package (including gaming and perhaps other casino services or amenities). It is possible that free tokens may have fees, rules, or the like which offset any player advantage (e.g., tokens are given out for free, but may only be used in certain game circumstances, such that a theoretical house advantage is preserved).

In still another embodiment, a player may receive the tokens as part of a payout from another game. For example, a slot machine may dispense tokens 32 as part of a cash out procedure, or may print a receipt for tokens 32 as part of a cash out procedure, said receipt then exchanged for tokens at a second location. In such instances, the payout may be reduced by the value of the tokens 32 provided, or the tokens 32 may be provided as a bonus to the player.

The player may also pay for the re-characterization token with a portion of the initial wager. For example, the player initially wagers five hundred dollars on the player hand, and then re-characterizes the wager as a "pair" wager. The player may pay twenty-five dollars from the initial wager so that the remaining four hundred seventy-five dollar wager is re-characterized.

For tokens 32 that have been purchased, the token may indicate the purchase value and/or the resale value. The resale value may be more, less or even money relative to what was paid depending on the terms of the sale.

In still another embodiment, the player may never actually handle the bet re-characterization token 32. Rather, the player may indicate, audibly or through a designated body motion or gesture, that the player desires to re-characterize her bet. The dealer may then select an appropriate bet re-characterization token 32 and place the token 32 on the player's wager stack 46.

There may also be restrictions on use of the token 32. One restriction may be who may use a token 32. For example, such tokens 32 may be available only to high rollers or members of the casino loyalty program. Or they may be free to high rollers, but other players may purchase the tokens 32 for a fee. Still another potential restriction might be placed on when a token 32 may be purchased. For example, tokens 32 may only be purchased between 10 AM and 4 PM. Alternatively, tokens 32 may be purchased at any time, but only used during specific times. Such time restrictions may be applied to that game play during peak action is not slowed. Another possible restriction is how frequently such bet re-characterizations may be used. For example, bet re-characterization may be restricted to once every X wagers or a certain number of times per time unit.

Tokens 32 may be color coded in a manner that does not designate a particular bet, but has meaning within the context of a game instance. For example, the tokens may be colored brown, blue, and purple. After the first cards have been dealt, the table 150 configures a set of appropriate re-characterization options, each of which is tied to one of the three token colors. The monitors 170 may be used to inform the players what a particular color means. Thus, for a given game instance, the brown is the win by two, the blue is switch, and the purple is banker 9. In another game instance, the brown is long shot, the blue is press, and the purple is push to next hand. In another game instance, blue tokens are placed during a first stage, whereas red tokens are placed during a second stage. Other arrangements are possible.

Still other mechanisms and locations for providing tokens and/or restricting their availability and/or use are possible.

Types of Re-Characterization Bets

There are many different ways bets may be re-characterized. As used herein, "re-characterize" and "re-characterization" are generic terms that encompass the various ways in which initial bets may be changed into new bets. Within the definition of re-characterization, there are three distinct embodiments.

The first embodiment is a re-characterization bet that supersedes the initial wager. If a re-characterization bet supersedes the initial wager, then the entirety of the initial wager becomes the new wager. There is no portion of the initial wager left. Likewise, the new wager is for the same amount of value as the initial wager.

The second embodiment is a re-characterization bet that subsumes the initial wager. If a re-characterization bet subsumes the initial wager, then the entirety of the initial wager becomes part of the new wager. There is no portion of the initial wager left. However, additional value is added to the initial wager such that the new wager is for an amount greater than the initial wager. Note that the additional value can come in the form of additional chips (e.g., a player increases her wager from $100 to $200) or from adding a bet re-characterization token 32 that has value (e.g., a player paid $10 for a token 32 and adds it to the initial $100 wager resulting in an effective wager of $110).

The third embodiment is a re-characterization bet that splits the initial wager into a re-characterized portion and a diminished remaining portion. For example, the player may make an initial wager of five hundred dollars on the banker position, and then re-characterize the initial wager by splitting the initial wager into a two hundred dollar wager on a pair and a three hundred dollar diminished initial wager on the banker position. The ratio of the split may be dictated by the re-characterization or by the player as desired. For example, some re-characterization bets may require a fifty-fifty split between the re-characterized portion and the diminished initial portion, others may require a seventy-thirty split or some other ratio, and still others may leave it to the player to decide how to split the initial wager. Note that for split bets, in some embodiments, two tokens may be used. The first token is put on the re-characterized portion as previously described, and the second token is put on the diminished initial portion and may state that the diminished initial portion is paid out at normal odds (e.g., the token indicates "even money" or "normal odds"). The two tokens may help reduce confusion by players that think both wagers are paid at the new odds and by dealers who may need to pay each stack of chips at different odds.

In contrast to a re-characterized bet, some of the bets described herein may also be implemented as side bets, second or "late" bets, or proposition bets. While there is a substantial body of literature on such bets, the concepts are distinct. Side bets differ from the concept of a re-characterized bet in that side bets keep the initial wager intact and add the side bet. For example, in THREE-CARD POKER, there is the ante bet (the initial wager) and the pair-plus wager (the side wager). Each wager is distinct and does not affect the other. Late bets may be thought of as side bets that occur after an initial wager has been placed (e.g., during an intermediate stage of a game); however, these are additional bets, and do not re-characterize the initial wager. Likewise, some of the bets described herein may be implemented as a proposition bet (commonly, a bet with somewhat long odds that may be placed without an accompanying base game wager). Again, the concepts are distinct. A proposition bet does not rely on any pre-existing initial wager that is re-characterized. Rather, the proposition bet is a standalone bet on a particular event such as a hard way eight in craps.

Figure 8:
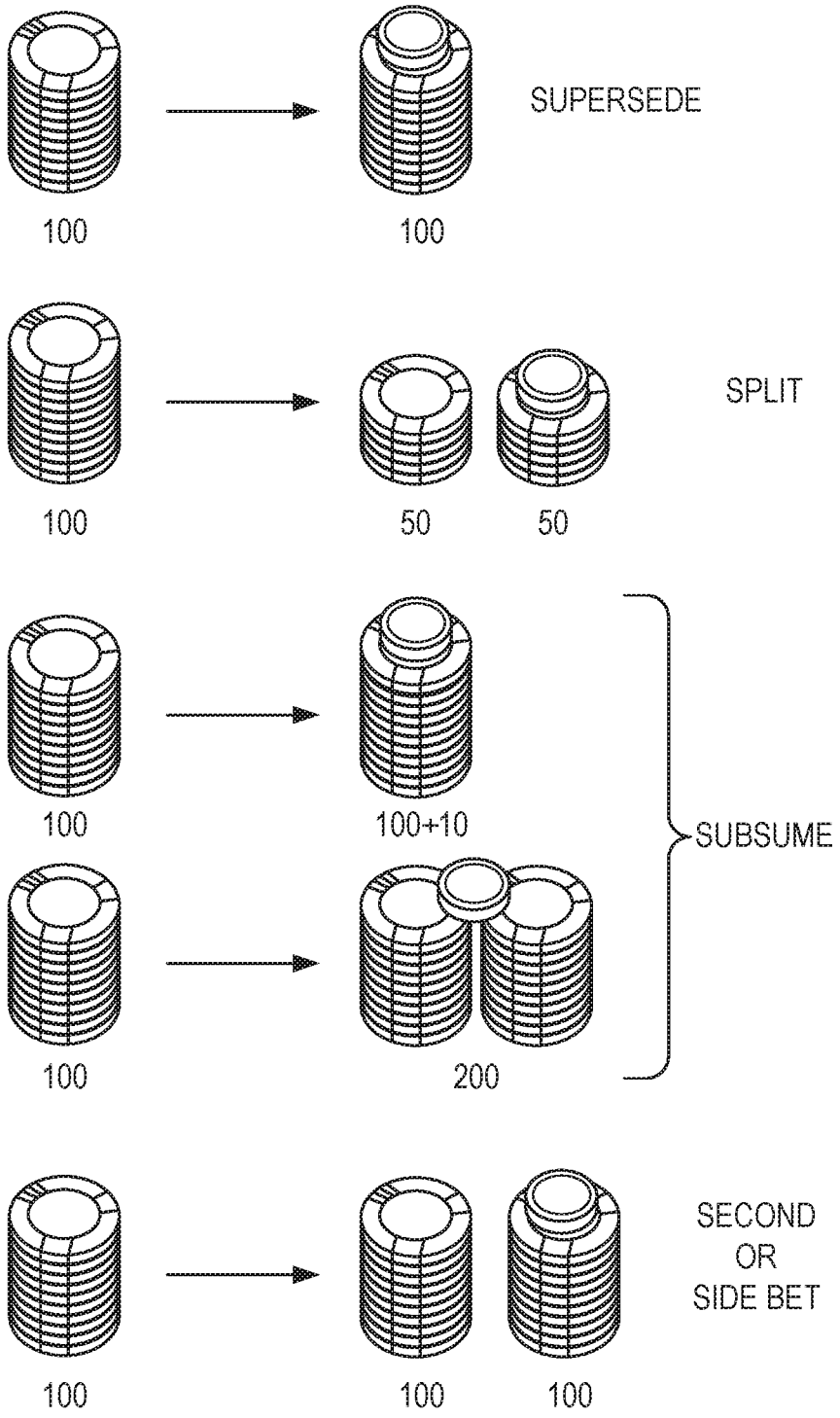
FIG. 8 illustrates various embodiments of re-characterization compared to a second bet.

A summary of the various definitional distinctions is presented in FIG. 8. What follows is a list of various particularly contemplated types of bet re-characterizations. Note that many of the different types may be implemented as supersede re-characterizations, subsume re-characterizations, or split re-characterizations.

"Win by X"—Ex: A player places a "Win by Two" token, his original bet must now win by a margin of at least two. If it does, he may be paid at a higher rate. Any margin amount may be substituted for X. Outcomes of a tie or push may result in a loss of the player's bet.

"Roll Over"/"Next Hand"/"Pass"—Ex: When a player places a "Roll Over" token, his original bet is "pushed forward" or moved to a subsequent hand. In one example, the player must post an additional minimum bet on the subsequent hand to do this. In other words, the player might "rescue" a disadvantaged original bet from Hand #1 and push it forward to Hand #2, but he must also agree to post a separate minimum bet on Hand #2. If the original bet from Hand #1 wins on Hand #2, it pays at lesser odds (e.g., dynamically calculated based on the first four cards dealt in Hand #1). In one embodiment, the bet for the second hand must be at least equal in amount to the bet for the first hand. In other embodiments, an additional minimum bet on Hand #2 may not be required; instead, by playing a "Next Hand" token, a bet form Hand #1 is simply pushed forward to Hand #2 where it pays at lesser, adjusted odds if it wins.

"Two (or more) in a Row"—Ex: A bettor wagers $100 on "banker". After the initial deal, it becomes clear that the banker side is ahead, 8-2. The bettor then places a "Two in a Row" token. The bettor must now win this hand as well as the subsequent hand. If he does, he is paid at better odds (e.g., the calculation considers the odds of winning the first hand given the first four cards, as well as the odds of winning the second hand, and a house edge). In one embodiment, the bet for the second hand must be at least equal in amount to the bet for the first hand, though a new bet for the second hand may not be required. In a variation of this, a player could bet that he will lose two or more hands in a row. In another variation, the player can bet that he will win a predetermined amount of hands over the course of two or more hands.

"9 Insurance"—Ex: A bettor places a bet on "banker" in baccarat. After the first four cards are dealt, the banker is ahead, 7 to 5. The player places a "'9' Insurance" token. If the bettor wins, his original bet is paid at a lesser rate (e.g., dynamically calculated based on the first four cards dealt). If the bettor loses to a "9" (the "player" position draws a "4"), his bet pushes. Thus, the insurance protects players from losing to a "9". In variations, bettors might be protected from opposing outcomes other than "9". For example, insurance might protect against any loss by a margin of 1 (a "bad beat").

"Add 2"/"Extra Points"—A player of a baccarat game can indicate that he or she would like to "purchase" extra points at any time towards the hand he or she has wagered upon. For example, after the first four cards have been dealt, two to the Player Hand and two to the Banker Hand, the Player has "4" and the Banker has "6". Bettor A wagering on the Player Hand may then indicate (e.g., by use of a token) that he or she wants two points added to the Player Hand total. The hand is then resolved, however when bets are settled, Bettor A's wager is settled based on the final total of the Player hand+2 and the final total of the Banker hand. In some embodiments, a player may have the option to "deduct" or subtract points from one of the hands on the table. If the bettor is putting himself in a worse position, he or she may be given a benefit (e.g., a bonus, a higher payout, advantageous rule change, etc.). In some embodiments, points can always be added to a hand unless they give the player a Natural. A player with a "7" cannot use a +2 chip because it results in a natural. In some embodiments, points are not added if the hand results in a natural without the added points (e.g., the Player hand results in a "9", even for a bettor that has used a +2, the hand total is still 9 (the +2 is ignored on specified predetermined totals)). In some embodiments, points are always added regardless of the outcome (e.g., the Player hand results in a "9", but a bettor that has used a +2 now has a "1"). In some embodiments, regardless of what the next/hit card is, the points are added to the hand. In some embodiments, the traditional hit rules apply to those who have used the "extra point" option. For example, normally, the Player Hand hits on anything less than a five and stands on 6 or above. If the Player Hand has a "4" and chooses to add 2, resulting in a "6", then the hit does not apply (e.g., the Player Hand becomes pat for that specific player). The same rules may be used if the player has wagered on Banker. For example, the Player Hand totals "4" and the Banker Hand totals "4". Bettor A uses a +2 option for the Banker hand resulting in a "6" and the Player Hand then draws a "4". The Dealer deals another card for the Banker, but it does not apply when settling Bettor A's wager according to the hit rules in baccarat.

"Press"—Ex: By using a "Press" token, a bettor can increase his bet mid-way through a hand. For example, if after the first four cards of a baccarat hand it appears that the bettor is in an advantageous position, he can place a token and increase (e.g., double) his bet. Both his original bet and the late bet may be paid at an adjusted rate (e.g., dynamically calculated based on the first four cards dealt) thus resulting in a re-characterization of the initial wager. In other embodiments, only the added amount may pay at an adjusted rate.

"Switch"—Ex: After betting on "banker," a bettor decides mid-way through a baccarat hand he'd rather bet on "player". The bettor places a "Switch" token and the player's bet switches sides. The bet is paid at an adjusted rate (e.g., dynamically calculated based on the first four cards dealt).

"Split (to Tie)"—Ex: After betting $100 on "player," a baccarat bettor decides he'd like to take some of his original bet and place it on another outcome. For example, the bettor takes $25 from the base bet, and adds a "Split to Tie" token on top. Thus, his original bet has now been split between two outcomes—the $75 base bet pays 1:1 if "player" wins, and the $25 bet pays at an adjusted rate should a tie occur (e.g., dynamically calculated based on the first four cards dealt). As described, this is an example of a split re-characterization.

Card-Matching Bets—Ex: A player of a baccarat game may place a wager on a card-matching outcome involving cards in play. For example, the outcome may use cards from both hands, sometimes including the hit cards as well. Exemplary matching outcomes that may be wagered on via re-characterization include: four of a kind (e.g., any four of the same value card, or four cards of a specific value, such as four eights), straight, flush, full house, straight flush, cards of the same color, or the like.

"Any Pair"/"Late Pair"—Ex: After the initial deal, the bettor can bet that his hand includes a pair (if it does not already, or if it does, perhaps he can bet that his hand will include three matching cards). If the hand in question includes a pair after the draw, the player is paid at adjusted odds (based at least in part on the post-deal expected value (EV) of his original bet and the likelihood of achieving a pair).

"Perfect Late Pair"—Ex: Same as "Late Pair," except cards must be a perfect match, and pays at longer odds.

"Tie-Breaker"—Ex: A player may use an option that breaks any possible ties. For example, if the player has chosen to have a tie-breaker, the player is paid if the hand wagered on wins the hand OR on a tie, and the wager is collected if the hand loses.

"Draw to '9'"—Ex: After a player has seen a partial deal, the player may make a wager that the final total of his or her hand will be a predetermined number (e.g., the first two Player Cards total 5, a player may indicate or wager that the hit will bring the final to total to "9").

"Deny the Hit"/"Two-Card Hand"—Ex: A player may choose not to have one or more dealt cards count towards the final outcome. For instance, the first card dealt to Player is a "7". At this point, a player may indicate that any other cards dealt to the Player hand do not count (i.e., he or she locks the "7" as the player hand total).

"Take Down"—Ex: A player may be able to rescue a losing wager by pulling back all or a portion of a wager. For example, by playing a "Take Down" token, a player in a disadvantageous situation can remove half of his original bet, with the remaining half paying an adjusted payout upon win.

"Sure Thing"/"Instant Win"/"Settle"—Ex: After betting $500 on "player," a baccarat bettor sees after the first four cards are dealt that his bet is at an advantage (e.g., he is ahead 7-3). Rather than risk losing the bet to a bad beat, the bettor places an "Instant Win" token. This token settles the bet for its Expected Value (EV), minus a house edge (though the amount subtracted from the EV may consider other factors, such as player status). This "locks in" the player's win.

"Free 6"—bettor can request a "Free 6" in baccarat after seeing the initial deal. Ties may result in a push, or may result in the bettor's loss. Wins are paid at an adjusted rate.

"10 is a 2"—Ex: After the initial deal, the bettor can play a "10 is a 2" token and turn all 10-value cards for the side he has bet on into a "2". Any card value can be changed to any other card value with this mechanic. Wins are paid at an adjusted rate.

"Pushes Lose"/"Ties Lose"/"No Tie"—Ex: After the initial deal, the bettor can play a "Pushes Lose" token. If he wins, he is paid at better odds. If he ties, his bet is lost.

"Pushes Win"/"Ties Win"—Ex: After the initial deal, the bettor can play a "Ties Win" token. If his hand ties or exceeds the opposing hand, his bet wins, but is paid at an adjusted rate.

"Hop Bets" (e.g., 9-0)—Ex: After the initial deal, the bettor can bet that the current hand will resolve to a particular point score on both sides (e.g., 9-0). The bet can be re-characterized to wager on any such specific score, or range of scores. Each would pay at its own adjusted odds.

"Long Shot"—Ex: After the initial deal, the table can calculate the "longest shot" in terms of point score on both sides, and offer this bet. Players can re-characterize and bet only on this long-shot, which pays at high odds.

"Win Two Ways"—Ex: After the initial deal, the bettor plays a "Win Two Ways" token. First, the side he originally chose must win according to standard baccarat rules. However, the same side must also win according to a cumulative count of the card values in each hand (e.g., 5-7-3 is a "15" by this count, in contrast to being counted as a "5" in standard baccarat rules). If the bettor wins both of these, he is paid at adjusted odds. Winning one is not enough, and the bettor loses his bet.

"Freeze"—Ex: in some situations, a player may be dealt a preferable hand, but because of the strict draw rules in baccarat, the hand ends early. For example, a deal with a Player hand of 6 and a Banker hand of 7 ends after the deal. In such a situation, a player may place a "freeze" token to allow her wager or hand total to roll into the next hand. For example, a player bets on Player and the initial deal is 7-7. The player places a freeze token on his wager which carries the player total of 7 into the next hand. The player's payout is rated in the next hand and she may be required to add additional value to the wager.

"Alternate Draw"/"Reach Back"—Ex: in some situations wherein a draw does not usually occur, a player may wish to force a draw. Wins may be paid at an adjusted rate. The extra card may come from the shoe, a previous hand, an electronic random number generator, or other source as desired.

"Split"—Ex: as is common in blackjack, a player may be able to split a two-card baccarat hand into separate hands, and play each separately against the opposing hand.

A variety of late options related to a wager in baccarat are discussed in co-owned U.S. Provisional Patent Application Ser. No. 61/020,470, filed Jan. 11, 2008, entitled "Method and Apparatus for Playing Baccarat with Late Play Options" which is incorporated herein by reference for all purposes. Additional description of similar actions that may be performed in baccarat can be found in Applicant's co-pending U.S. Provisional Patent Application Ser. No. 60/939,263, filed May 21, 2007 and entitled "SYSTEMS, METHODS AND APPARATUS FOR ADDITIONAL GAME OPTIONS IN BLACKJACK, BACCARAT AND OTHER GAMES".

While the above discussion focuses on baccarat, a brief discussion of possible re-characterization bets within blackjack is also appropriate. Many of the re-characterization bets described above also apply to blackjack and are not repeated. If there is a variation applicable to blackjack, but the bet remains essentially the same, only the variation is described.

"Switch"/"Switch Sides"/"Bet the Dealer"—Ex: See baccarat description. The player switches sides and bets on the dealer's hand. The player's hand may be played out according to known rules for perfect strategy. If the player's hand busts or otherwise loses, the "Switch" re-characterization wins.

"Pushes Win"/"Pushes Lose"—In some embodiments, the player can only exercise this re-characterization with a pat hand.

"Bust Only"—Ex: When a blackjack player places a "Bust Only" token, he only wins if the dealer busts. However, should this occur, he is paid at better odds.

"Face Down Hit"—Ex: After the initial deal, the player uses a "Face Down Hit" token. He is given a single hit card, face down. If the dealer busts, the player wins his bet without the hit card ever being overturned. If the dealer reaches a pat hand, the player's hit card is overturned and the hands are compared. Wins are paid at an adjusted rate. In some embodiments, this wager would not be applicable on hands of 11 or less; must be hard 12 or above.

"Double Face Down Hit"—Ex: Like a "Face Down Hit," but the player must accept two cards face-down. If the dealer doesn't bust, both must be applied to the player's hand.

"Double Hit"/"Best Hit"—Ex: After the initial deal, the player uses a "Double Hit" token. The player is then dealt two hit cards, from which he may select one to apply toward his hand. Wins are paid at an adjusted rate.

"Bet to Bust"—a Blackjack player having a hand total of 12-16 inclusive may choose to place an additional bet that the next hit card he receives will cause him to bust. The option of the additional bet may not be displayed to a player (or shown as "N/A") if he does not have a hand that is either a 12, 13, 14, 15, or 16. The additional bet may be limited to an amount equal to the player's initial bet, and may receive an adjusted payout based on information relating to game play. Such information may include: cards that are viewable by the player, odds associated with game play, and information relating to the player's one or more wagers. For example, a Blackjack player places a $20 wager and receives a J and a 6, for a total of 16, while the dealer's "up-card" is shown to be a 7. Since the player's hand falls within the range of 12-16, a display screen outputs a message to the player, "Bet You're Going to Bust! Additional wager is paid 3:5." The player signals to the dealer that he wishes to use this option by placing an additional $20 bet. The player then receives a 10 as a single hit card, giving the player a hand totaling 26. The player's hand has resulted in the bust, thus he loses his original wager, but wins his additional bet and is paid $12.

"Double Play"—Ex: After the initial deal, the player places a second bet and uses a "Double Play" token. His initial hand is "copied," and east set of cards is dealt to twice. Wins on the second hand (and perhaps also the first hand) are paid at an adjusted rate.

"Triple Down"—Ex: In addition to doubling down, the player can place a third bet and use a "Triple Down" token. The third bet is paid at an adjusted rate.

"Auto 18"/"Sure 18"/"Free 18"—Ex: After the initial deal, a player can play an "Auto 18" token to automatically change his hand value to 18. The player takes no more cards. Payouts are adjusted based on the player and dealer starting hands. In one embodiment, a player could "downgrade" a blackjack to an 18 and get paid good money upon a win.

"Split Any"—Ex: The player can split any pair of cards he chooses. Payouts are adjusted based on the circumstance (e.g., splitting a 10-5 might result in a higher payout if the 5 hand wins than if the 10 hand wins). In some embodiments, both hands must win for the player to win his re-characterization. In other embodiments, a win on only one hand might trigger a push or an individual payout for that hand. An additional bet may, or may not, be required.

"1 Card Only"—Ex: After the initial deal, a player can play a "1 Card Only" token, and take exactly one more card. If he wins, he is paid at a higher rate.

"2-Card Hit"—Ex: Player uses "2-Card Hit" token and receives two hit cards, both of which must be used. If player wins, he is paid at rated odds. Similar to "1 Card Only," but requires two cards.

"Bust Insurance"—Ex: After the initial deal, a player can play a "Bust Insurance" token to protect himself from busting. The player is allowed to take only one more card. If the player wins, he is paid at an adjusted rate. Ex #1: When a player uses a "Bust Insurance" token, and ends up busting a hand, the player is given a "17". Ex #2: When player receives a hit card that busts a hand, a different hit card is used. The player can keep hitting until he gets a pat hand without busting. Ex #3: When a player receives a hit card that busts a hand, a different hit card is used, but the player is allowed only one such replacement hit card.

"New Hand"—Ex: Player sees his initial two cards and doesn't like the look of things. He plays a "New Hand" token and gets a new set of cards. The new hand, including splits and doubles, pays at adjusted (lesser) odds.

"Dealer 18"—Ex: When behind, the player can use a "Dealer 18" token to force the dealer's hand to a value of 18. If the player wins, he is paid at adjusted odds. Bet may not be available when player has an 18 (can't force a push intentionally) or dealer has a blackjack. When player is ahead, "Dealer 18" and "Settle" are equivalent. The odds calculation must consider that player who was behind might end up pushing by giving the dealer an 18, though he wouldn't have earned a push without use of the token (or, rules can indicate that pushes lose).

"21 or Bust"—Ex: After the initial deal, the player re-characterizes his base bet such that he now only wins if he reaches a count of 21. The player hits his hand until a count of 21, or until a bust occurs. Bet pays at adjusted odds. Not available on blackjacks.

"5-Card Charlie"—Ex: Player uses a "5-Card Charlie" token, and if he beats the dealer with a hand containing 5 or more cards, he wins at better odds. If the player "quits early" (wins before five cards), he is paid at rated odds worse than 1:1.

"Table Wins"—Ex: This bet must occur before any active hands on the table are hit. When a player places a "Table Wins" token, he changes his original bet such that it only pays if every active player hand wins during the current round. Any player push or loss may result in a loss of the original bet. Wins are paid at higher, adjusted odds.

"Player Insurance"—after an initial deal of a Blackjack game, a player may be offered an insurance premium/fee. If the player pays the premium/fee, winning payouts remain the same, however he is able to retain a portion of his initial bet if he loses his hand. For example, if the player loses he may only lose half of the original bet and is allowed to keep the other half. The insurance fee may be calculated based at least in part on the expected value of a player's hand when compared to a dealer's up-card. In one example of this option, a Blackjack player makes a $20 initial wager and receives a hand count of 19 versus a dealer up-card of 8 in the initial deal. The player is offered to pay $1 in order to insure that he cannot lose more than 50% of his initial wager. The player accepts the offer, pays the $1 fee, while play continues. The player stands at 19, and the dealer finishes the game with a 20. Although the player has lost to the dealer, the $1 insurance payment allows the player to retain half of his initial wager. The player pays the house $10 from his initial wager, and retains the remaining $10.

"Super21"—a player, after viewing an initial deal, may choose to place an additional bet that their hand total will end up being exactly 21. The option of the additional bet may only be displayed if the player's base hand falls within a certain range. The additional bet may receive an adjusted payout based on information relating to game play. Such information may include: cards that are viewable by the player, odds associated with game play, and information relating to the player's one or more wagers. In one example, a Blackjack player places a $20 wager and receives a J and a 6, for a total of 16, while the dealer's "up-card" is shown to be a King. A display screen then outputs a message to the player, "Bet You're Going To Hit 21!! Additional wager is paid 6:1." The player signals to the dealer that he wishes to use this option by placing an additional $20 bet. The player then receives a 5 as a hit card, giving the player a hand totaling 21. The player stands on 21, while the dealer turns over his hole card to reveal a 6. The dealer then receives a 5 as his next hit card, also giving him a total of 21. The player's hand has resulted in a push with the dealer, thus he retains his original wager, but wins his additional bet that his hand value would be 21, and thus collects $120.

"Dealer Has a 20"—Ex: After the initial deal, the player uses a token to bet that a dealer has a 20. If the dealer ends up with a 20, the player is paid at adjusted odds. If not, the player loses his bet.

"Match Bet"—following an initial deal, a player may be offered a chance to place an additional "match bet" on the prospect of winning one or more "match bet" payouts. To decide the match wager, the player is dealt second hand; preferably the second hand is only used for the match game and not played against the dealer. A different payout may be offered for one or more of the following match types: matching two card hand value (e.g. 19 and 19); matching individual card counts (e.g., a 9,7 and a 9,7); and an identical two card match (e.g., King-d, 2-c and King-d, 2-c). An offered payout amount may be correlated to the type of match and the probability that a match may occur. In one example, a player bets $20 and is dealt a 9-d and 7-c. The player is offered to place a "match bet", which may payout one of three different payouts: $14 for a hand count match; $28 for matching individual card counts; and $100 for a match consisting of two identical cards. The payer places a $10 match bet, and is dealt 9-h and 7-h. Play continues, the player takes a hit, draws a 10d, busting his hand. His original bet is lost, however he is paid $28 for his match bet. Other elements may be compared against the player's hand in such a manner (e.g, the dealer's hand, an electronic hand, and the like).

"Hole Card Match"—Ex: Player uses a "Hole Card Match" token, and if the player's hand includes a card that matches the dealer's hole card, he wins his re-characterization.

"Blackjack Split"—Ex: Player dealt a blackjack can split the two cards and win a large payout if he beats the dealer on one, the other, or both.

"Add 4"/"Add 5"—Ex: Player uses a token to add a point value of 4 or 5 to his hand, and is paid at rated odds. Any such value may be added or subtracted.

"Prereveal"—Ex: Player uses a token for the opportunity to see the hole card before she acts. If the player wins, the player is paid an adjusted amount. Play may occur out of order, in that players who do not place these re-characterizations act, the hole card is revealed, and then players that have placed this re-characterization acts. The adjusted payout may be based on the cards known before the reveal or after the reveal as desired.

Variable—a name for a bet re-characterization may change from hand to hand. The change may be deterministic (e.g., each bet re-characterization is assigned a name, and the names are rotated through alphabetically), random, or based on the particular cards that are dealt. The odds for the variable bet may be better, worse, or the same as the odds for the same bet placed outside the variable context. Note that this type may be applicable to baccarat as well.

Additional description of similar actions that may be performed in blackjack can be found in Applicant's co-pending U.S. Provisional Patent Application Ser. No. 60/939,263, filed May 21, 2007 and entitled "SYSTEMS, METHODS AND APPARATUS FOR ADDITIONAL GAME OPTIONS IN BLACKJACK, BACCARAT AND OTHER GAMES".

As alluded to above, the odds for the re-characterized wager are infrequently the 1:1 or 0.95:1 odds of the initial wager. Rather, the re-characterized wager may be paid out at odds that are determined by one or more of the following factors: (i) the probability that the re-characterized wager will result in a win (e.g., given at least the current cards in play), (ii) the amount of the original bet, (iii) the expected value (EV) of the original bet, (iv) a player status rating (some players may receive better payouts than others), (v) rules for rounding payouts to even amounts, and/or (vi) a house advantage (the house pays winning re-characterizations "EV minus a given house advantage, plus/minus any modifications for player status). The modified odds are sometimes referred to herein as the adjusted odds or the rated odds. Similarly, the payout may sometimes be referred to herein as the adjusted payout or the rated payout.

In one embodiment, all re-characterized bets are paid out at fixed adjusted odds, regardless of what cards are showing at the table. In another embodiment, the adjusted odds may vary depending on the nature of the re-characterization wager and/or the cards on display at the time the re-characterization wager is made (i.e., the cards shown are used to help calculate the expected value of the various re-characterization wagers). Because it may be difficult for the dealer and players to remember a large number of dynamic adjusted odds, the dealer and/or player may use a look up table or the like that shows what the odds are for a particular deal. For the simple embodiment shown in FIGS. 1-7, the look up table may be available for players and dealers to review in the form of a book. Each page of the book could have a different re-characterization wager on it with a table that shows all the possible hands and the odds. Additionally, a column or entry may be provided that describes the payout per $100 (or other desired denomination) wager. An example of such a page from such a book is presented in FIG. 9. When the intermediate outcome is revealed, the player and/or the dealer may refer to the look up table and determine the odds and the potential payout for the wager stack 46 that the player currently controls for a given deal. Based on the published odds, the player may decide whether or not to re-characterize the bet. Again, it is worth noting that the odds for the re-characterized wager may be more favorable for the gaming establishment than the normal house edge for the game.

The adjusted payouts may further take into consideration rules for rounding payouts to even amounts so that fractional amounts do not have to be tracked. A rules based system of a computing device might even dynamically determine (i) a direction for rounding (up or down) and/or (ii) a denomination to round to based on numerous factors, such as (a) recent rounding decisions, such that an overall advantage is maintained across numerous instances of rounding (e.g., some round up, some round down, resulting in an overall balance); (b) the player's bet amount, and the like. A recent history of payouts considered for rounding may be associated with a casino, table, player or other element.

In summary, re-characterizing a bet may change a condition for payout such as by making a condition for payout more restrictive (in which case, the payouts may be increased), less restrictive (in which case, the payouts may be decreased), or have comparable likelihood of occurring. Additionally, the player may choose to add winning events to the wager in play such that the player may receive two payouts. This embodiment is particularly useful for split type re-characterizations. Examples include initially wagering on banker and then re-characterizing through a split the wager as a "Banker 9" wager. Thus, the player may win a first amount if the banker wins and a second amount if the banker wins with a 9. Re-characterization may increase or decrease the likelihood that a player wins. As noted, the payouts may increase or decrease accordingly to preserve a desired house edge.

Electronic Table

Figure 10:
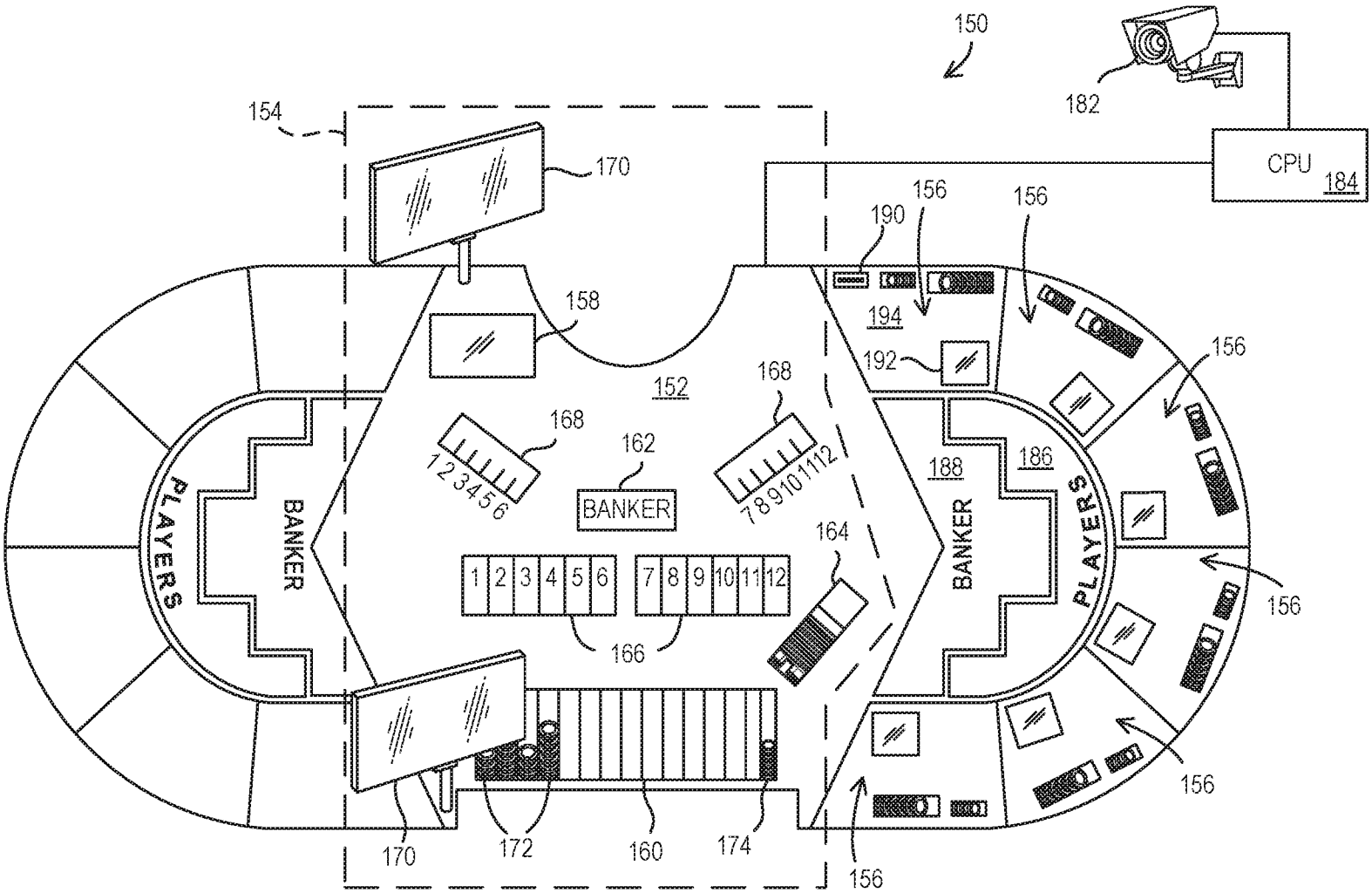
FIG. 10 illustrates a top planar view of a smart table.

While the above discussion has focused on providing embodiments of the present disclosure without requiring any hardware changes or changes to the table 10, there is no reason why the table must remain unchanged. For establishments that are willing to have a more expensive table, various electronic components may be added to the table to improve efficiency and ease the implementation of bet re-characterization. It should be appreciated that there is a continuum between the simple table 10 presented above and one that has all the proverbial bells and whistles. A more robust table 150 is presented in FIG. 10.

The table 150 has a planar top surface 152 on which game play takes place. The table 150 further has a dealer station 154 and at least one player station 156. The dealer station 154 has space for the various dealers to stand or sit and may include a dealer monitor 158, a chip rack 160, a banker hand area 162, a shoe 164, a commission recordation area 166, and a tie wager area 168. Additionally, monitors 170 may be positioned proximate the dealer station 154 in such a manner that all the players may perceive the monitors 170. While two are shown, it should be appreciated that more or fewer may be used as desired. The present disclosure also sometimes refers to the monitors 170 as a tote board.

The dealer monitor 158 and the monitors 170 may be displays as that term is defined in the Rules of Interpretation set forth below. It is particularly contemplated that the dealer monitor 158 has touch screen functionality. Alternatively a keyboard or other input mechanism may be provided (not shown). The dealer monitor 158 may be used to inform the dealer which players are owed how much as a payout on re-characterized bets or normal bets. Additionally, the dealer monitor 158 may inform the dealer when to hit the player hand or banker hand, what the point totals are, how much is owed by players for commissions, how many comp points are due a particular player, how much a player has won or lost, whether a player is trying to make a re-characterization bet that is valid or invalid, or other information as desired.

The monitors 170 may be used to provide information about historical outcomes so that players may review the historical outcomes. Additionally, the monitor 170 may list what bet re-characterizations are available and the adjusted odds or payouts associated with any such re-characterization. If a particular bet re-characterization is not currently available, it may be grayed out, listed as "N/A" or otherwise denoted in such a manner that players may understand that the particular bet re-characterization is not available. Again, monitors 170 may be implemented in a variety of manners, not restricted to the number of monitors 170 appearing at a table or the type of monitor being used. Monitors 170 may take the form of a physical sign, perhaps with physically adjustable components to indicate changes to payouts or odds (e.g., an attendant can "call up" or swap in a new set of odds or payouts for a given re-characterization type and/or game circumstance by making a few simple changes).

Figure 11:
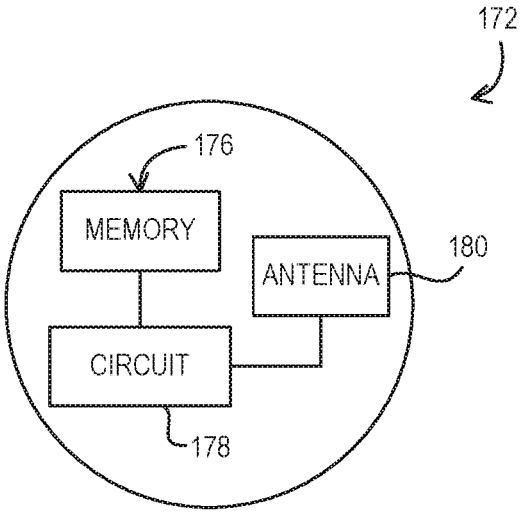
FIG. 11 illustrates a simplified schematic diagram of an RFID chip.
Figure 12:
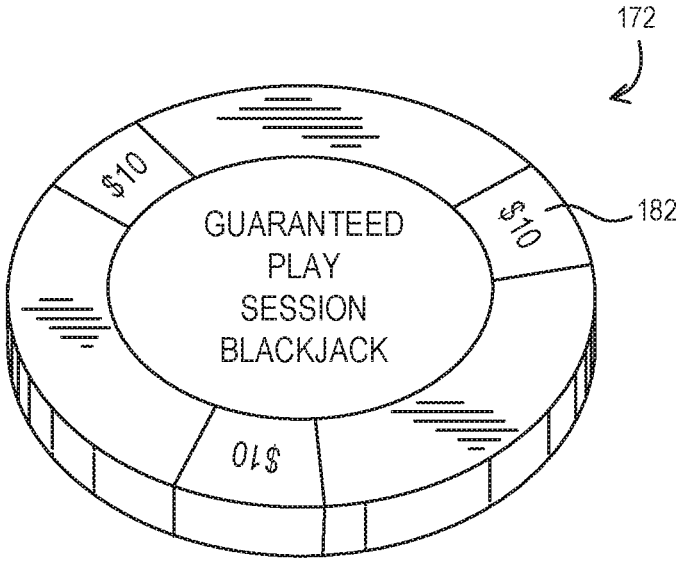
FIG. 12 illustrates a perspective view of the chip of FIG. 11.

Chips 172 (also illustrated in FIGS. 11 & 12) and tokens 174 may be positioned in the chip rack 160 and used throughout the table 150. The chips 172 may include a radio frequency identification (RFID) tag or memory 176 with an electronic circuit or processor 178 and an antenna 180 (see FIG. 11). The chip 172 may be similar or identical to those disclosed in U.S. Pat. Nos. 5,166,502; 5,676,376; 6,021,949; and 6,296,190, and U.S. Patent Application Publication Nos. 2004/0207156 and 2004/0219982 which are all incorporated by reference in their entireties. Gaming Partners International (GPI), of 1182 Industrial Road, Las Vegas, Nev. 89102 and Shuffle Master, Inc. of 1106 Palms Airport Drive, Las Vegas Nev. 89119 both sell RFID chips suitable for use with the table 150, although neither product is specifically required to practice the concepts of the present disclosure. The GPI chip uses a standard microchip made by Philips Semiconductors called the Vegas S, each of which has a unique serial number. The gaming establishment (e.g., casino) or other entity may associate values with each serial number. The association may be in a look-up table or the like. Alternatively, the unique identifier may be encoded to include information therein. Likewise, the chips 172 may be color-coded or include other indicia, such as indicia 182 (FIG. 12) that indicate values to the player or dealer.

In use, the electronic circuit 178 and antenna 180 act as a transponder capable of responding to an interrogator (not shown). In essence, the interrogator sends out an electromagnetic signal that impinges upon the antenna 180, exciting a current within electronic circuit 178. In response to the excited current, the electronic circuit 178 causes the antenna 180 to emit a second electromagnetic signal as a response, which is received by the interrogator. The second signal has identifying information about the chip 172 encoded therein such that the interrogator can identify the chip on receipt of the second signal. The second signal may be generated passively or actively. That is, in a first embodiment, the energy from the interrogation signal provides sufficient power for the electronic circuit 178 to use to send the second signal. In a second embodiment, the electronic circuit 178 may include a battery or other power source, which is used to power the generation of the second signal. While batteries have increasingly small footprints and longer lives, it is generally more practical to have a passive transponder.

It is further contemplated that the tokens 32 may be RFID tokens, each having its own unique identifier. A database may link the unique identifier with a particular bet re-characterization and other information as desired. For example, the database may detail to whom the token 32 was issued, any wager restrictions, any time of use restrictions, a cost associated with the token 32, or other information.

A camera 182 may be positioned over the table 150 and operatively connected to a central processing unit (CPU) or processor 184 associated with the table 152. The CPU 184 may be a control system as that term is defined in the Rules of Interpretation provided below and may control and coordinate the functions of the various components of the table 150.

The chip rack 160 may be an RFID interrogator. An exemplary chip rack of this sort is made by GPI under the trade name CHIP BANK READER. Alternatively, the interrogators described in U.S. Pat. Nos. 4,814,589; 5,283,422; 5,367,148; 5,651,548; and 5,735,742—all of which are incorporated herein by reference in their entireties—could be used. Another RFID tag and interrogator suitable for use with at least some embodiments of the present disclosure are produced by Texas Instruments as the TAG-IT™ product line. An improved interrogator is discussed in U.S. Patent Application Publication 2006/0077036, which is also incorporated by reference in its entirety.

The shoe 164 may be an intelligent shoe such as the IS-T1™ and IS-B1™ or the MD1, MD2 sold by Shuffle Master or comparable devices. The shoe 164 may be able to determine which cards are being dealt to which player station through RFID technology, image recognition, a printed code on the card (such as a barcode), or the like. The particular technique used to recognize cards is not central to the present disclosure. Further information about intelligent shoes may be found in U.S. Pat. Nos. 5,941,769 and 7,029,009, both of which are incorporated by reference in their entireties and U.S. Patent Application Publications 2005/0026681; 2001/7862227; 2005/0051955; 2005/0113166; 2005/0219200; 2004/0207156; and 2005/0062226 all of which are incorporated by reference in their entireties. In place of an intelligent shoe, cameras, such as camera 182 may be used with pattern recognition software to detect what cards have been dealt to what player stations, what chips 172 have been wagered, and what tokens 32 have been used by particular player stations. One method for reading data from playing cards at table games is taught by German Patent Application No. P44 39 502.7. Other methods are taught by U.S. Patent Application Publication 2007/0052167 both of which are incorporated by reference in their entirety. Similarly, cameras 182 may be used to detect when a token was given or removed from a specific player. This information may be helpful should the gaming establishment need to audit a session.

The player station 156 may include a player bet area 186, a banker bet area 188, a player tracking mechanism 190, a player monitor 192, and a chip reserve area 194. As before the player bet area 186 and the banker bet area 188 are delimited by indicia onto which the player may place a wager stack 46. However, the player bet area 186 may include one or more interrogators 196 (FIG. 13) which detect chips 172 and tokens 32 placed in the player bet area 186. Likewise, the banker bet area 188 may include one or more interrogators 198 (FIG. 13) which detect chips 172 and tokens 32 placed in the banker bet area 188.

The player tracking mechanism 190 may be a card reader adapted to receive a magnetic stripe card such as is commonly used in gaming establishments. Alternatively, the player tracking mechanism 190 may be a smart card reader, an RFID interrogator that interrogates a player tracking RFID fob, TITO device (for reading player data encoded on a ticket), or other device as desired.

The player monitor 192 may be a display as that term is defined in the Rules of Interpretation set forth below. The player monitor 192 may be a touch screen display and/or have associated input elements such as a keypad or keyboard. Collectively, the player monitor 192 and any associated input elements are termed a player interface. Information about the player, about the available bet re-characterizations, a history of outcomes, any adjusted odds or payouts for a particular available bet re-characterization, or other information may be presented on the player monitor 192 as described herein. In a first embodiment, each player station 156 has its own monitor 192. While not shown, the player station 156 may also include a bill acceptor and/or a cashless gaming receipt device such as the TITO bill validating device such as a FutureLogic GEN2™ PSA-66 device configured to operate within an EZ-PAY™ system by IGT. Another variation is to use a mobile terminal such as a personal digital assistant, palm-style computer, cellular phone, hand held or laptop computer as a display.

Figure 13:
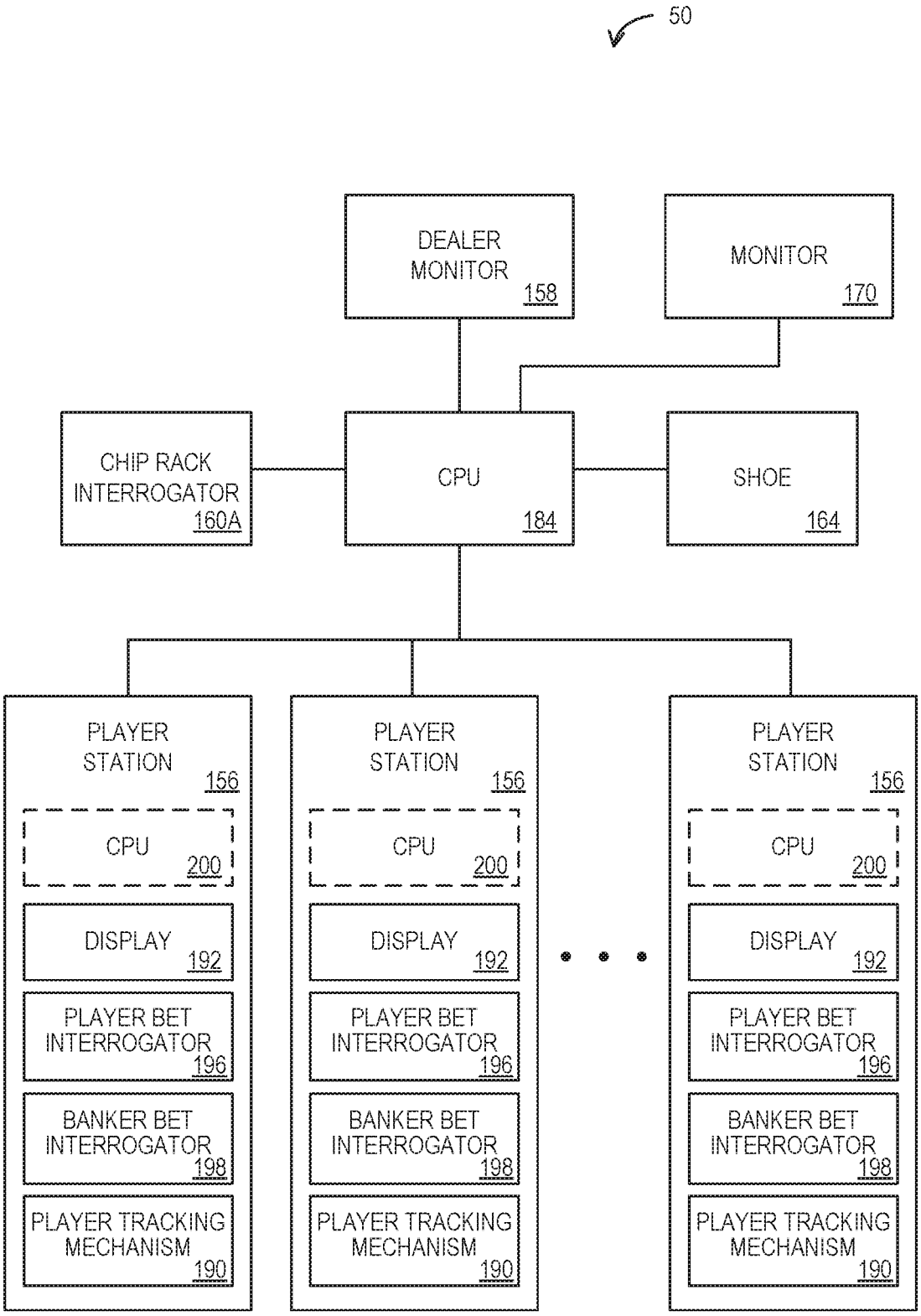
FIG. 13 illustrates a block diagram of the table of FIG. 10.

The various electronic components of the table 150 may communicate with one another as better illustrated by the block diagram of FIG. 13. The CPU 184 may act as the brains of the table 150. The CPU 184 may be part of the table 150 or may be remotely positioned therefrom. It is possible that the CPU 184 may be a central server that controls multiple tables concurrently if desired. The CPU 184 may be communicatively coupled to the various components through a network (not labeled) as that term is defined in the Rules of Interpretation set forth below, a bus, or other communication system as desired.

The CPU 184 may control all the various components and perform all the calculations according to software stored in a computer readable format in a memory unit (not shown). For example, the CPU 184 may receive data from the shoe 164 and or the interrogator 160A associated with the chip rack 160. Likewise, the CPU 184 may control the player tracking mechanisms 190, the monitors 192 and any sensors that track bets such as player bet interrogator 196 or banker bet interrogator 198. Alternatively, functions specific to individual player stations 156 such as control of the monitor 192, interpretation of data from the interrogators 196, 198 and the like may be controlled by player station processors 200. As yet another alternative (not illustrated), a single player station processor 200 may control all the player stations and a second CPU 184 control the table such that the single player station processor 200 is a client for the CPU 184.

While the table 150 is particularly contemplated, it may be possible to modify an existing table to include the functionality of some or all of the embodiments of the present disclosure. For example, PGI, with Shuffle Master and IGT, sells an intelligent table under the moniker INTELLIGENT TABLE SYSTEM™ together with software entitled TABLE MANAGER™ Other intelligent table systems sold by Progressive include the TABLELINK PLAYER TRACKING, TABLELINK CHIP TRACKING, TABLELINK GAME TRACKING, TABLELINK TOTALVIEW, and TABLELINK CUBE. Further intelligent table teachings can be found in U.S. Pat. No. 5,779,546 (outputting instructions to a dealer via a display screen); U.S. Pat. Nos. 6,676,517 and 7,011,309 as well as U.S. Patent Application Publications 2002/0147042; 2003/0003997; 2005/0026680; 2005/0051965; 2005/0054408; 2006/0014577 (player-specific push buttons and display screens in communication with a table game computer); 2006/0205472 (touch-screen displays allowing player/dealer input at table games); 2007/0026930 (automated table game), all of which are incorporated by reference in their entireties. Likewise, instead of all the sensors described herein, the dealer may provide a running commentary that is transcribed and provided to the CPU 184, thereby providing the same information to the CPU 184. One such system is the BLOODHOUND system sold by Shuffle Master. It should also be noted that such technology may be repurposed for use by players to request certain actions (bets, re-characterizations, etc.).

Against such an automated table 150, the dealer's tasks and record keeping associated with the play session are greatly eased and facilitated by the automation of the table. An example of an exemplary method of using such a table 150 is presented with reference to the flow chart of FIG. 14.

The player initially approaches the table 150 (block 250). The player inserts her player tracking card (block 252) into the player tracking mechanism or otherwise provides player tracking information. Alternatively, if the dealer recognizes the player, the dealer (or pit boss) may enter the sufficient information to identify the player to the CPU 184. A player history may be accessed by the CPU 184 (block 254). The CPU 184 may access information stored on a central server associated with the gaming establishment to find the player history. Any player preferences may be retrieved if they are stored by the gaming establishment. Likewise, any credit limits, player ratings, or other relevant information may be retrieved. Based on the player history or a player request, the dealer may issue chips 172 and bet re-characterization tokens 32 to the player (block 256). The dealer may link the RFID identifiers of each chip and token so issued to the player station 156 to which the chips and tokens are being issued, to the particular player identifier to which the chips and tokens are being issued, or the like (block 258).

The dealer may indicate that wagers are being accepted, and the player may place an initial wager (block 260). The CPU 184 determines and registers or stores an indication of the amount of the wager through the appropriate interrogator 196, 198, the camera 182, or similar mechanism (block 262). The dealer deals the cards (block 264). The shoe 164, the camera 182, or other mechanism is used by the CPU 184 to determine what cards were dealt to the player and what cards were dealt to the banker (block 266) and this information is stored.

Figure 15:
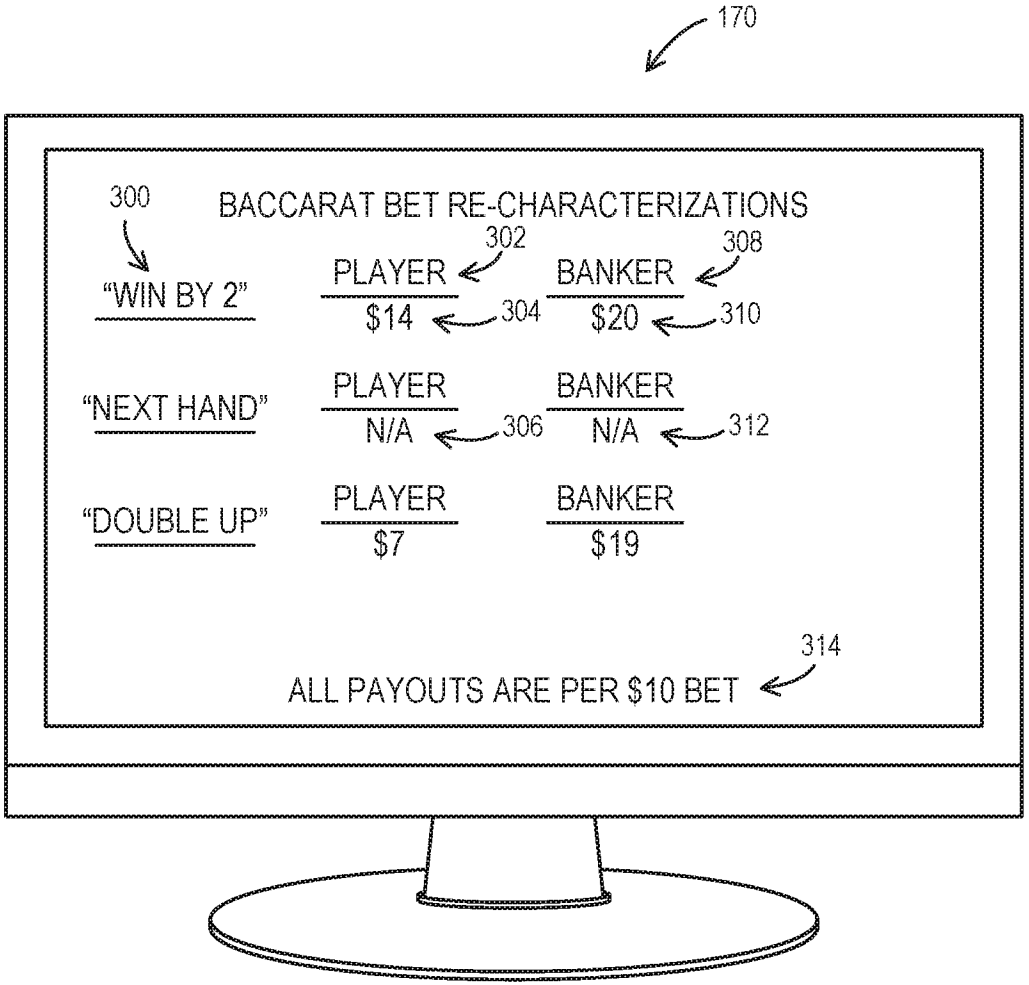
FIG. 15 illustrates a screen shot of a monitor from the table of FIG. 10.

Based on the cards dealt, the CPU 184 may calculate, look up, or otherwise determine what would be appropriate adjusted odds for all available re-characterized bets (block 268). For each available re-characterized bet, the CPU 184 may then publish the adjusted odds on the monitor 170 (block 270). An exemplary screen shot from monitor 170 is illustrated in FIG. 15. Specifically, the monitor 170 displays the name of the re-characterized bet 300, a player column 302 and a banker column 308. For example, a win by two re-characterized bet shows that a $10 wager pays $14 (element 304) in player column 302 and pays $20 (element 310) in banker column 308. Likewise, the next hand re-characterized bet is not available (element 306 and 312) in both player and banker columns 302, 308). Additional information 314 may be provided as a legend or the like to help explain the basis of the number in the columns. In this example, the numbers are based on a $10 wager (payouts are expressed as a function of a hypothetical bet amount). Other methods of expressing adjusted payout amounts include: (i) expressing a net payout considering an individual player's wager, (ii) expressing a gross payout considering an individual player's wager, or (iii) a "Bet X to win Y" relationship or ration that expresses what must be bet to win a certain amount.

Figure 16:
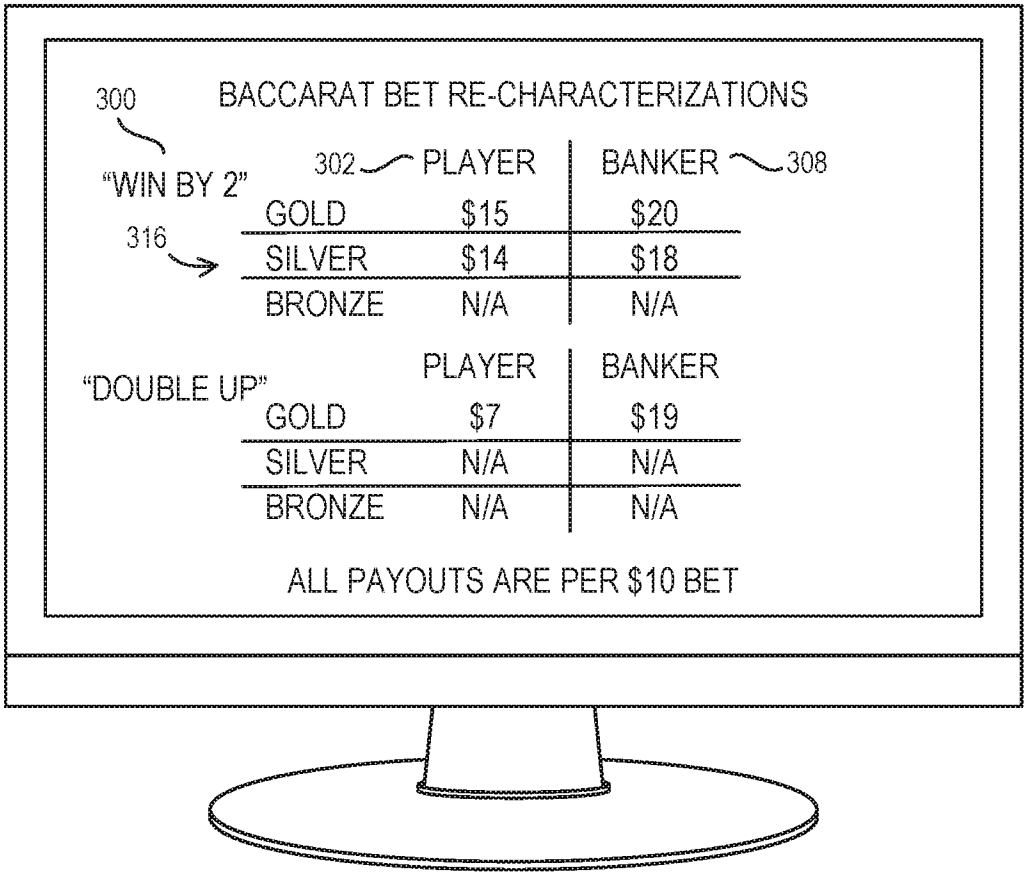
FIG. 16 illustrates an alternate screen shot of a monitor from the table of FIG. 10.

By having the player information, some additional variations may be provided. In particular, the gaming establishment may make the bet re-characterizations more attractive to its best customers. In particular, the CPU 184 may not only publish the general adjusted odds on the monitor 170, but it may also publish adjusted odds based on the level of the player as illustrated in FIG. 16. In the illustrated screen shot, the columns 302 and 308 are further divided (element 316) by level of player, where gold level players have better adjusted odds than silver level players, and bronze level players are not eligible to place either wager.

Figure 17:
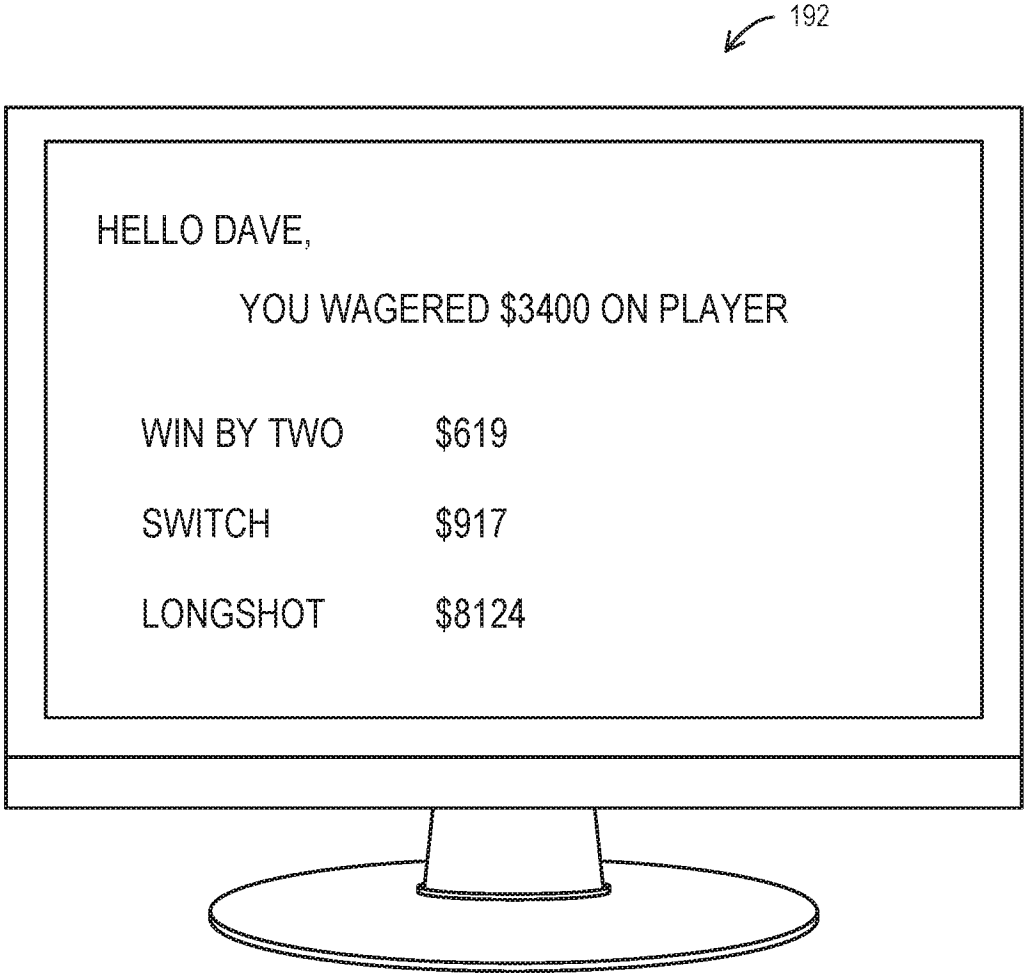
FIG. 17 illustrates another alternate screen shot from a monitor from the table of FIG. 10.

Note that the information on the monitor 170 may be published on the player monitors 192. Alternatively, each player monitor 192 may provide personalized information about what re-characterization wagers are available for that player and at what odds. Likewise, because the player's wager is known by the CPU, the particular adjusted odds may be published to the player based on the player's wager. An exemplary screen shot is presented in FIG. 17. A personal greeting may be provided which acknowledges the amount and type of wager the player made as well as lists the re-characterized wagers available to the player and what the payout for each would be.

Figure 14:
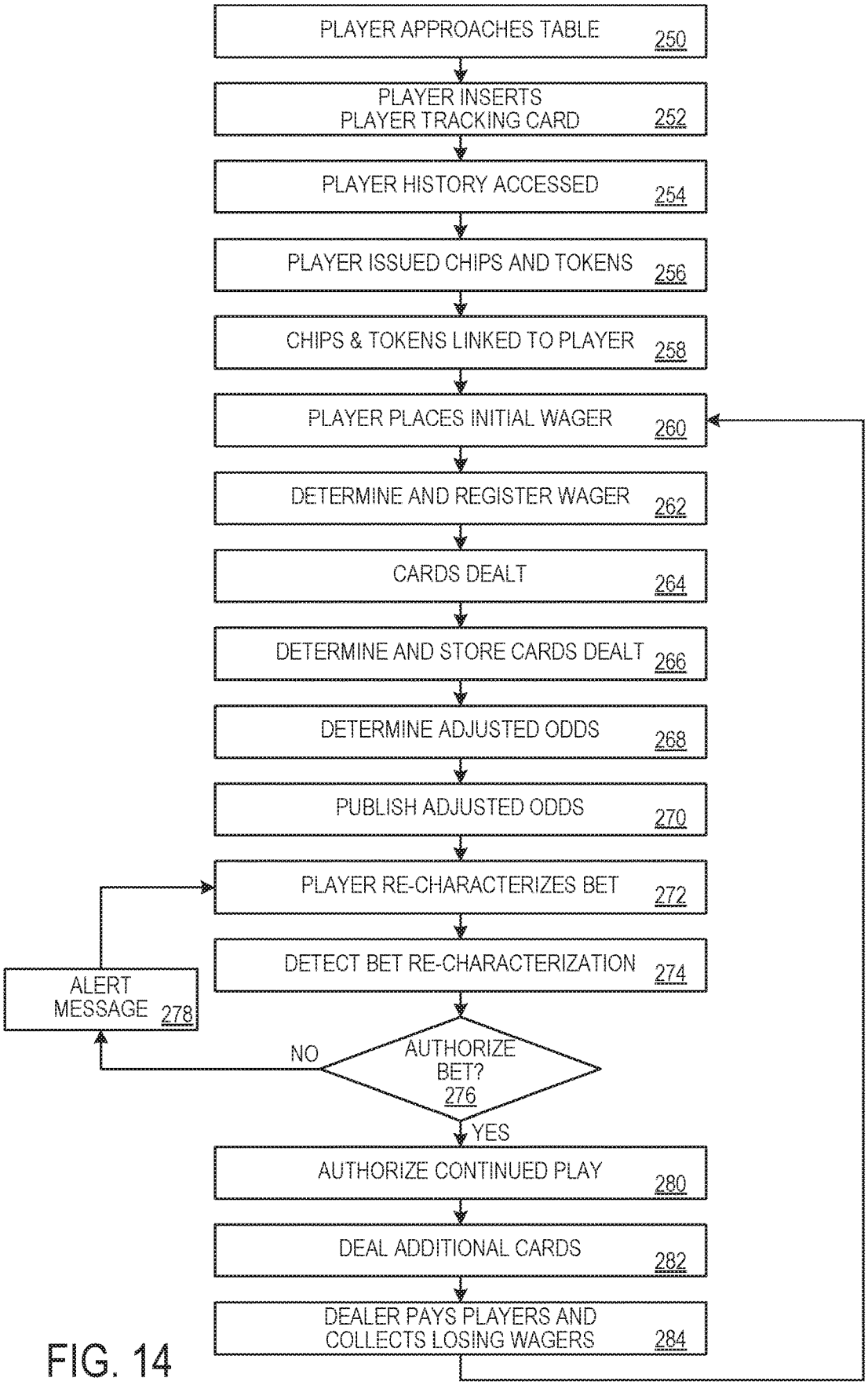
FIG. 14 illustrates a flow chart showing an exemplary method of use of the table of FIG. 10.

Returning to the flow chart of FIG. 14, the player places a re-characterization token 32 on the wager stack 46 of chips 172 (block 272). The CPU 184 may detect the use of the token 32 through the appropriate interrogator 196, 198 (block 274). The CPU 184 may store information associated with this event in memory. For example, a time stamp, a player identifier, a token identifier, a wager amount, and other information may all be stored. The CPU 184 may determine if the player is authorized to make that particular bet re-characterization (block 276) based on the information stored about the player and the bet re-characterization that the player is attempting to make, and if the player is not so authorized, a warning message may be presented (block 278) such as by displaying the message to the player through the player monitor 192, the dealer display 158, an audible tone sounding, or the like as desired.

Once an appropriate amount of time has passed, the CPU 184 may detect no further bet re-characterizations and may authorize the dealer to continue play (block 280). Alternatively, the dealer may visually inspect the table 150 and determine that no further bet re-characterizations are to be made and continue play. Still another variation is that the dealer may orally inform the players that no further bet re-characterizations will be accepted and continue play. The dealer deals the additional cards as required by the rules of baccarat (block 282). Again, the cards are detected by the appropriate mechanism (e.g., the shoe 164, camera 182) and the CPU 184 is updated as to what hands have what values. Based on the known value of the hands, and the known wagers, and the known re-characterized wagers, the CPU 184 may indicate what wagers are winning wagers, what wagers are losing wagers, and how much should be paid to each winning player. This indication may be provided through the dealer monitor 158, the monitors 170, and/or the player monitors 192 as desired. The dealer then pays the winning players and collects the losing wagers (block 284). Note that commissions owed may be indicated in real time on the player monitor 192 or other location as desired. If appropriate, the CPU 184 may adjust the value of a payout to collect an owed commission, and the player may be informed of this changed payout.

The CPU 184 may update the player history, update commission owed data, or perform any other administrative task necessary, and the process repeats as indicated. When the player leaves the table, the CPU 184 may provide an indication of the commissions owed, and the player may settle such debt accordingly.

Note that for circumstances where the initial wager is split (or there are otherwise two wager stacks) the interrogators 196, 198 may need to have two interrogators for each bet location so that the CPU 184 may discriminate between which portion of the bet is the diminished initial wager and which portion has been re-characterized. Alternatively, the dealer may make such an indication through a BLOODHOUND system, the cameras 182 may detect the different stacks, or other technique as desired.

As an aside, the CPU 184 may impute a number of active players based on the number of wager stacks 46, number of tokens 32 in play, or other activity. This imputation may be helpful where a player does not have a player tracking card or the dealer forgets to enter player information when the player sits down.

In some embodiments, an electronic table may comprise a fully virtual table, featuring electronic or simulated cards, chips, dealer and/or outcome determination (e.g., an electronic roulette wheel as opposed to a mechanical wheel). Of course, not all components may be virtual (e.g., a live roulette wheel communicates with an otherwise virtual table). Numerous such devices are contemplated. For example, Shuffle Master manufactures a multiplayer electronic table marketed as the TABLE MASTER. In some embodiments, memory of a computing device associated with such a table may be loaded with software for executing steps of the present disclosure. For example, display screens with which players may interact allow for selection of re-characterizations, whether by using virtual tokens or selecting some other virtual representation (e.g., a graphical box) indicating an available re-characterization. Wagers and payouts may occur in electronic credits.

Intermediate Table

Figure 18:
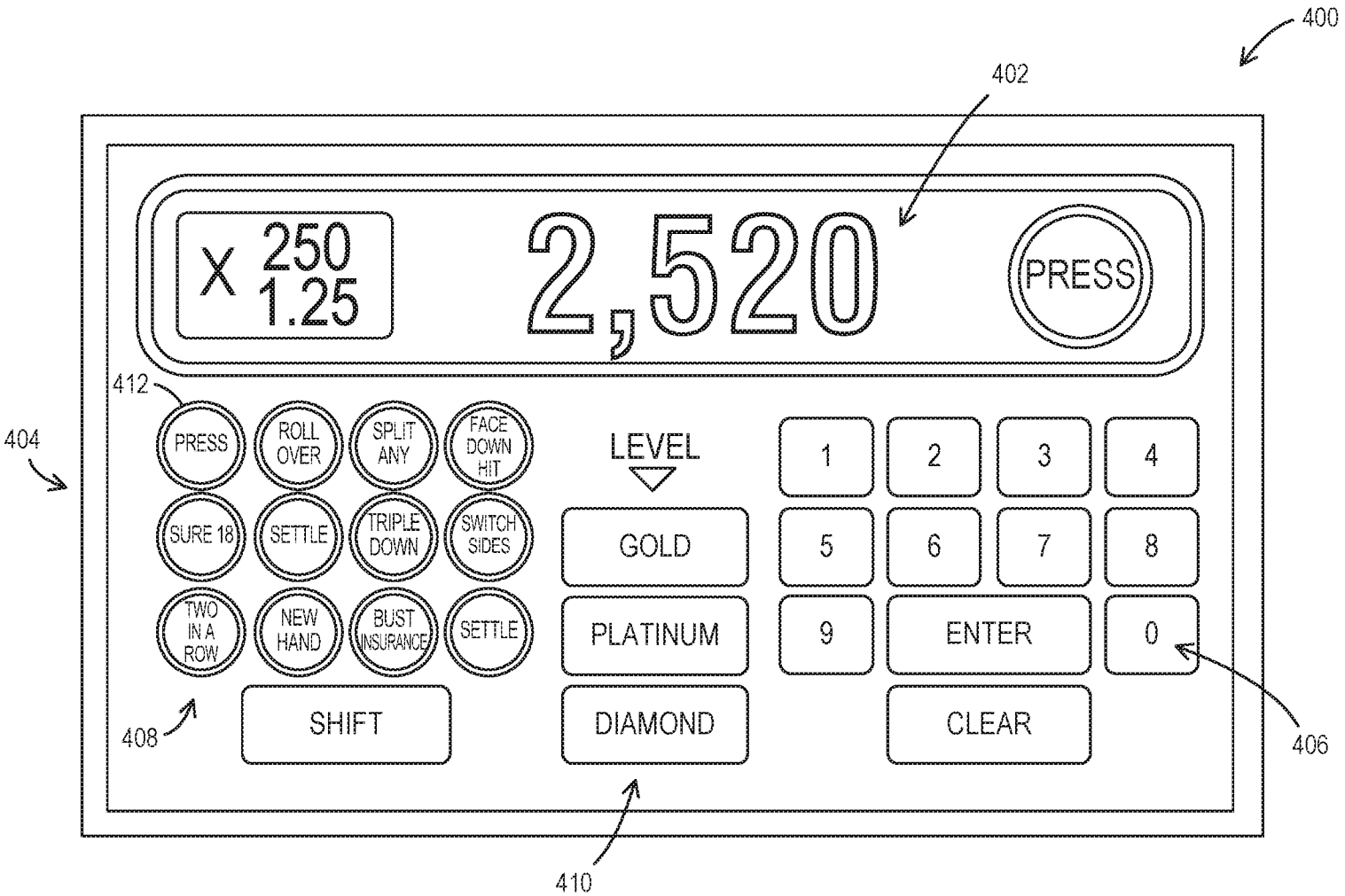
FIG. 18 illustrates an adjusted payout calculator.

Short of the electronic table 150, but smarter than the table 10, there are numerous intermediate tables where some of the functions that would be attributed to the dealer might be automated. For example, instead of monitors 158 and 192, players and dealers may be provided calculators to assist them in determining adjusted payouts. In one embodiment, such calculators may be stationary or part of the table (perhaps implemented through dealer display 158). IN a second embodiment, the calculators are mobile terminals 400 (see FIG. 18). The mobile terminal 400 has a control system (not shown) with associated memory to contain software adapted to perform the functions described herein. The mobile terminal 400 further has a user interface with a display 402 and a keypad 404. Alternatively, a display may include touch screen functionality. The keypads may include a numeric keypad 406 for entry of wager amounts, bet keypad 408 for entry of the type of bet re-characterization, and a player rating keypad 410 for entry of the player level. The keys and display 402 may color code so that when a yellow press key 412 is pressed, the background of the display 402 turns yellow. The software may step a user through adjusted odds calculation. For example, a first screen may solicit entry of the banker hand; a second screen may solicit entry of the player hand; a third screen may solicit the amount and placement of the initial wager, and so on. The user then enters the desired bet re-characterization and the player level and receives an adjusted payout amount. Dealers may use this before paying out bets; players may use this before making bets; and supervisors (with separate mobile terminals for validation) may use this to verify large payouts. For more information about such calculators, the interested reader is directed to U.S. Provisional Patent Application Ser. No. 61/024,850, entitled METHODS, SYSTEMS AND APPARATUS FOR SECURING AND MONITORING DYNAMIC PAYOUT SYSTEMS, filed Jan. 30, 2008 and U.S. Provisional Patent Application Ser. No. 61/026,950 entitled METHODS, SYSTEMS AND APPARATUS FOR SECURING AND MONITORING DYNAMIC PAYOUT SYSTEMS, filed Feb. 7, 2008 which is hereby incorporated by reference in its entirety. The METHODS, SYSTEMS AND APPARATUS FOR SECURING AND MONITORING DYNAMIC PAYOUT SYSTEMS application also describes many security provisions which may be implemented to prevent cheating at the table.

Alternate Embodiments

Tokens

In addition to the tokens described above, other types of tokens may be used and may be appropriate for particular circumstances. One such other example of a token could be a token that is formed from a plurality of matched parts (e.g. a re-characterization token may snap apart into halves, thirds, fourths, etc.). This type of embodiment may be useful when an original bet is split between multiple outcome events or there are multiple wagers on which to place re-characterization tokens. E.g., re-characterization tokens may be sold in packages in order to regulate what types of outcomes a player may wager upon when splitting. Thus, two tokens may fit together or be stuck together (e.g., magnets, Velcro, etc.) and indicate a package of outcome events, each of which can potentially cause the wager to be paid. Matched items may be used to indicate offsetting rules (in other words, one beneficial rule change and one negative rule change). E.g., a player may split his original blackjack bet into two equal stacks. On one stack he places the first half of a re-characterization token indicating that he needs to "win by 2." On the second stack of chips he places the second half of the re-characterization token indicating "no bust" insurance (if the player busts, he does not lose this stack). Alternate forms for the tokens include dice or other oddly shaped items, sleeves, or cards. Dice allow different bets to be placed on a single item. To identify the desired re-characterization bet, the player turns up the side of the die that has the desired bet re-characterization. Sleeves allow a player to wrap the initial wager with the sleeve to show it has been re-characterized. Cards allow the initial wager stack to be split. The chips above the card are the re-characterized portion and the chips below the card are the diminished initial portion (or vice versa).

In some embodiments, a re-characterization selector may be embedded within or otherwise attached to the table. A physical selector may allow for a player to select a re-characterization, such as by adjusting a slider or spinning a wheel (such that the device points to the appropriate re-characterization). An electronic selector may incorporate touch-screen buttons that a player may use to select her choice.

Figure 19:
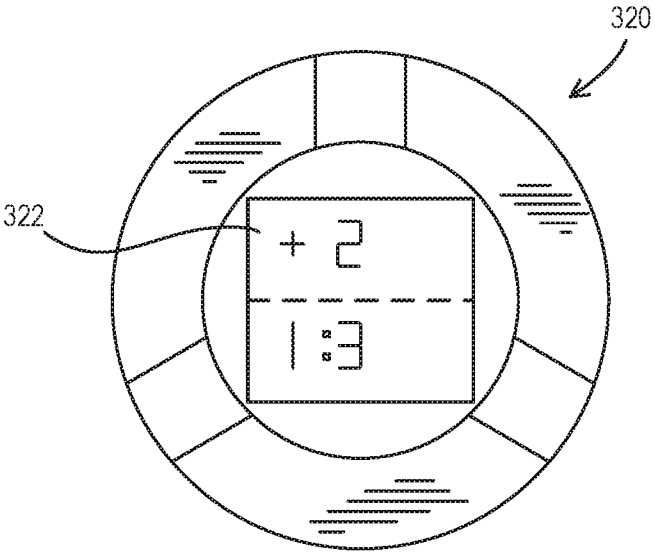
FIG. 19 illustrates an alternate re-characterization token.

In still another embodiment, the tokens may be electronic. For example, the tokens may have an electronic display associated with them. For example, as illustrated in FIG. 19, a token 320 may include an LED screen 322 which conveys the bet re-characterization type, the odds, and/or other information as desired. For more information about chips with such LED screens, the interested reader is directed to U.S. Application 61/023,290 filed on Jan. 24, 2008, entitled RECHARACTERIZATION OF BETS AT TABLE GAMES and U.S. Application 61/023,827 filed on Jan. 30, 2008, entitled RECHARACTERIZATION OF BETS AT TABLE GAMES which is hereby incorporated by reference in its entirety. An electronic token may feature electronic memory and communication means, such that the token may communicate with CPU 184, or with one or more RFID chips. For example, the token itself may indicate a re-characterization type to the CPU 184 or to the chips, which then might update hypothetical payouts accordingly. For example, a player may place an electronic "Add 2" token on top of a stack of $100 in RFID chips, thus indicating the desired re-characterization. Based on the desired re-characterization, the amount of chips in the stack, and the cards in play, the CPU 184 may indicate an adjusted gross payout of $184 on the $100 bet. Such tokens might be thought of as having the ability to talk down through any chips underneath them to the table, creating an opportunity to associate the entities electronically.

In another embodiment, instead of using tokens 32, the wager stack 46 may be simply moved to a different spot on the playing felt. Indicia may be provided for each available bet re-characterization, and the player moves the wager stack 46 to the desired re-characterization. Note that this embodiment has the side effect of changing the felt, which may be less attractive to some players. However, the success of the comparatively busy craps felt shows that players can adapt to more diverse betting options. If interrogators are used, each betting area may have its own interrogator so that such movement may be detected.

In still another embodiment, a player may be allowed to create her own token. Such a token may be created online and picked up during check-in, using a kiosk, or with the assistance of a gaming establishment representative. The token could reflect any particular rules for that player. Such a token is most easily effectuated with an RFID token, but other forms could be used. Using such a customized token, a customized re-characterized wager could be implemented, such as "switch and win by two. A player could update the token with a new re-characterized wager when desired (e.g., between hands). The information about the customized wager could be stored on the token if the token had sufficient memory, or in a database associated with the unique token identifier. Likewise, the player might update the information online.

The bet re-characterization concepts may also be extended to "back-betting" patrons (those not sitting at the table, but wagering from behind, perhaps by riding along on a seated player's bet). Such patrons might be given separate RFID betting circles on an electronic table, or one of the dealers may be assigned just to back bettors. Still other techniques may be used as desired. The presence of back bettors may give rise to the CPU 184 having to impute a number of active bettors at the table based on a number of distinct stacks, relative location of stacks, weight sensors, placement of tokens, and the like.

As an additional measure to protect the gaming establishment profits, the CPU 184 may track all the cards that have been played from a shoe. If the computational requirements are particularly heavy, a portion of the cards may be tracked. Alternatively, the discarded cards may be calculated into the current adjusted odds, but offset by one or more hands. For example, at hand ten, the cards from hands one through eight may be evaluated, and at hand eleven, the cards from hands one through nine are evaluated, and so on. In the rare situation where a shoe has a strange distribution of cards, certain re-characterized wagers, such as "Press" may have lower adjusted odds so that a card counter cannot take undue advantage of the odd shoe. Alternatively, there may be a cap or ceiling for payouts. The cap may be a fixed amount or relative to the initial wager (no re-characterized bet may pay more than 500:1 compared to the original wager).

The monitors 170 may list certain re-characterization bets as not available. This may be done as a function of time (e.g., a press bet is not available after 9 PM); as a function of cards already dealt (e.g., a player cannot take Quick 6 when he already has a 6); or to prevent bets that are grossly unappealing (e.g., a player bet $500 and the payout is $10). Still other reasons for showing a bet as not available exist such as player rating, wager size, or the like. The monitors may list payouts in gross form or net form as desired. Players may be informed of how the monitors are programmed. Note that with net payouts, some payouts may appear negative.

Instead of initially signifying to a bet re-characterization after the cards have been dealt, players may instead place re-characterization option tokens before any cards are dealt. For example, a player places an optional switch token at the outset of the hand providing her the opportunity to switch sides midway through the hand, if so desired. If she does not enact the option and wins, she is paid at an adjusted rate (most likely lower). If she uses the options, she may also be paid an adjusted rate or the standard rate.

In still another embodiment, single tokens may reflect combinations of bet re-characterizations such as switch and press.

Other Games

While the present disclosure has focused on baccarat, and to a lesser extent on blackjack, it should be appreciated that the concepts disclosed herein may be applied to mini-baccarat tables, craps tables, roulette tables, Sic Bo, Pai Gow, and other games of chance.

Alternate Prizes

After re-characterizing bets, players may be given prizes other than standard gaming chips or credits. Other prizes may include goods, services, "free" or promotional play of other casino games, "dead" chips that must be wagered once before they are considered cashable (e.g., a tote board indicates a re-characterization payout of $5,000 in dead chips or $4,800 in standard chips), discounts or coupons, etc. So-called "progressive" jackpots may also be applied.

Outcome History

Commonly, baccarat tables feature an electronic display of outcome histories. Such a display may be enriched if bet re-characterizations are available. The display might track or highlight "hot" re-characterizations that have resulted in above-average player win. Going a step further, such re-characterization history information may be personalized; this would be facilitated by the existence of personalized monitors 192, or an entirely virtual table. For example, a player's personal screen may show her statistics for each re-characterization (number of wins, number of losses, win percentage, amount won, amount lost), such that she can ascertain which re-characterizations have yielded better results.

Another element greatly facilitated by implementation involving player-specific monitors 192 or a virtual table: "requested" re-characterizations. For example, in a certain game circumstance, a player might like to know, "What would the house pay me if I changed my hand value to a 5? Or to a 4?". Conversely, midway through a hand, a player may wish to know, "How can I re-characterize my bet such that I am paid 10:1?". Player-specific displays can provide this information.

When and how to "Publish" Adjusted Payouts

As described, a tote board (example of monitors 170) may be used to communicate adjusted payouts players can except to win if they re-characterize bets in a certain manner. Depending on the sophistication of the system, these adjusted payouts may be "published" to the tote board in various manners (at various times). While an intelligent shoe 164 may communicate card data to CPU 184 as cards are removed from the shoe 164, it may not be appropriate to publish adjusted payout information for re-characterizations until one or more cards have been turned over or revealed. For example, in the game of baccarat, it is not uncommon for cards to be revealed or "squeezed" slowly, and it would be disadvantageous to disrupt this tradition by publishing payout information for re-characterization prematurely (and potentially mining the suspense of the "squeeze"). Thus, in one embodiment, a dealer may wait for the first four cards of a round of baccarat to be overturned before sending a signal to CPU 184, perhaps via a dealer monitor or other input device (e.g., a "Publish" or "Update Board" button, not specifically shown by FIG. 10), instructing that it is now appropriate to publish the adjusted payout information for re-characterizations. In other embodiments, a camera may be used to determine that one or more cards have been overturned, and transmit a signal to CPU 184 accordingly. It is specifically contemplated that an overhead camera system manufactured by Tangam Systems of Waterloo, Ontario, Canada (e.g., the TableEye21 or TableEyeBacc model) may be utilized for this, and perhaps other purposes.

Still other techniques for implementing the concepts of the present disclosure are contemplated. For example, all bets may have tokens 32 positioned on them to start a game, and the removal of the token 32 signifies a bet re-characterization. Tokens 32 may act like a dead chip, needing to be washed through or used once before it gains a negotiable value. Combination of tokens 32 may be used to remove restrictions. For example, a win by two token may have a restriction that it cannot be used in a double down situation. A second token may remove that restriction in exchange for different adjusted odds.

In addition to the security systems to prevent cheating, audit records may be created. Such audit records may come from the CPU 184, calculators provided to dealers and players, or other locations within the system as desired. Receipts may also be provided on request. These receipts may show the audit record. Audit records and/or receipts may be personalized (show a personal history of wins and losses, including success/failure with various re-characterizations and the like). Audit records may be provided to third parties, such as an insurer.

Rules of Interpretation & General Definitions

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate)

may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, Local Area Network (LAN), Wide Area Network (WAN), or Ethernet (or IEEE 802.3), Token Ring, or via any appropriate communications means or combination of communications means. Exemplary protocols include but are not limited to: BLUETOOTH™, TDMA, CDMA, GSM, EDGE, GPRS, WCDMA, AMPS, D-AMPS, IEEE 802.11 (WI-FI), IEEE 802.3, SAP, SAS™ by IGT, SUPERSAS™, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cellular networks, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. A system for facilitating a card game, comprising:

at least one table apparatus, each of the at least one table apparatus comprising:

at least one first component associated with a first player position included on the table apparatus, the first player position for placement of detectable wagering chips by a first player, a placement of at least one detectable wagering chip on the first player position serving as an indication of a wager being placed by the first player associated with the first player position;

at least one second component associated with a second player position included on the table apparatus, the second player position for placement of detectable wagering chips by a second player, a placement of at least one detectable wagering chip on the second player position serving as an indication of a wager being placed by the second player associated with the second player position; and a first processor operable to communicate with the at least one first component and the at least one second component in order to receive data therefrom;

at least one game controller operable to maintain a database of detectable wagering chips authorized for use on the at least one table apparatus, the game controller comprising a second processor; and a memory accessible to the second processor, the memory storing a program, wherein the second processor is operable with the program to:

(a) store in the database a respective unique identifier for each detectable wagering chip;

(b) store in the database a respective user identifier, if any, associated with each detectable wagering chip;

(c) store in the database a use restriction, if any, associated with each detectable wagering chip, wherein the use restriction defines at least one characteristic of a game event that must be satisfied in order for the detectable wagering chip to be accepted as a wager for the game event, such that the detectable wagering chip may simultaneously be acceptable to wager in a first game event that satisfies the at least one characteristic but not acceptable to wager in a second game event that does not satisfy the at least one characteristic;

(d) receive data from the at least one table apparatus indicating an event that was detected by at least one of the first component and the second component, the data including a unique identifier of one of the detectable wagering chips; and (e) update in the database, for the detectable wagering chip corresponding to the unique identifier received in (d) and based on the data indicating the event, at least one of: (i) the user identifier, if any, and (ii) information associated with the use restriction, if any.

2. The system of claim 1, wherein the first processor and the second processor comprise at least one processor of the game controller.

3. The system of claim 1, wherein the at least one characteristic comprises at least one of a (i) a type of wager for which the corresponding detectable wagering chip may be used, (ii) a type of user participating in the game event and who is attempting to wager the corresponding detectable wagering chip; and (iii) a time during which the corresponding detectable wagering chip may be used.

4. The system of claim 1, wherein the at least one use restriction is a customized restriction customized for the user corresponding to the detectable wagering chip.

5. The system of claim 1, wherein step (e) is performed only if it is first determined that such an update is appropriate based on an analysis of the data indicating the event.

6. The system of claim 1, wherein the card game is baccarat.

7. A non-transitory, computer-readable medium for facilitating a card game on at least one table apparatus by maintaining a database storing data defining a plurality of detectable wagering chips authorized for use on the at least one table apparatus, storing instructions which cause a processor to perform a method, the method comprising:

(a) storing in the database a respective unique identifier for each detectable wagering chip;

(b) storing in the database a respective user identifier, if any, associated with each detectable wagering chip;

(c) storing in the database a use restriction, if any, associated with each detectable wagering chip, wherein the use restriction defines at least one characteristic of a game event that must be satisfied in order for the detectable wagering chip to be accepted as a wager for the game event, such that the detectable wagering chip may simultaneously be acceptable to wager in a first game event that satisfies the at least one characteristic but not acceptable to wager in a second game event that does not satisfy the at least one characteristic;

(d) receiving data from the at least one table apparatus indicating an event that was detected by at least one of the first component and the second component, the data including a unique identifier of one of the detectable wagering chips; and (e) updating in the database, for the detectable wagering chip corresponding to the unique identifier received in (d) and based on the data indicating the event, at least one of: (i) the user identifier, if any, and (ii) information associated with the use restriction, if any.

8. The non-transitory, computer-readable medium of claim 7, wherein the at least one characteristic comprises at least one of a (i) a type of wager for which the corresponding detectable wagering chip may be used, (ii) a type of user participating in the game event and who is attempting to wager the corresponding detectable wagering chip; and (iii) a time during which the corresponding detectable wagering chip may be used.

9. The non-transitory, computer-readable medium of claim 7, wherein the at least one use restriction is a customized restriction customized for the user corresponding to the detectable wagering chip.

10. The non-transitory, computer-readable medium of claim 7, wherein step (e) is performed only if it is first determined that such an update is appropriate based on an analysis of the data indicating the event.

11. The non-transitory, computer-readable medium of claim 7, wherein the card game is baccarat.

* * * * *